US005310642A

United States Patent [19]

Vargas, et al.

[11] Patent Number: 5,310,642

[45] Date of Patent: May 10, 1994

[54] DIR COUPLERS WITH HYDROLYZABLE INHIBITORS FOR USE IN HIGH PH PROCESSED FILMS

[75] Inventors: J. Ramon Vargas, Webster; Paul A. Burns, Rochester; Phillip D. Knight, Fairport, all of N.Y.

[73] Assignee: Eastman Kodak Company, Rochester, N.Y.

[21] Appl. No.: 7,440

[22] Filed: Jan. 22, 1993

[51] Int. Cl.[5] ..... G03C 7/32; G03C 7/34; G03C 7/18

[52] U.S. Cl. ..... 430/544; 430/223; 430/564; 430/957

[58] Field of Search ..... 430/544, 957, 223, 564

[56] References Cited

U.S. PATENT DOCUMENTS

| | | | |
|---|---|---|---|
| 4,477,563 | 10/1984 | Ichijima et al. | 430/544 |
| 4,782,012 | 11/1988 | DeSelms et al. | 430/544 |
| 4,849,325 | 7/1989 | Sasaki et al. | 430/544 |
| 4,937,179 | 6/1990 | Hirano et al. | 430/544 |
| 5,004,677 | 4/1991 | Ueda | 430/382 |
| 5,021,333 | 6/1991 | Vetter et al. | 430/544 |

FOREIGN PATENT DOCUMENTS

| | | |
|---|---|---|
| 0440466A1 | 1/1991 | European Pat. Off. . |
| 0488310A1 | 11/1991 | European Pat. Off. . |
| 2251950 | 9/1990 | Japan . |

*Primary Examiner*—Richard L. Schilling
*Attorney, Agent, or Firm*—Gordon M. Stewart

[57] ABSTRACT

A silver halide photographic light-sensitive material for development in a development solution at a pH of at least 11.4 is disclosed. The material comprises a support having a silver halide emulsion layer comprising a compound capable of releasing a development inhibitor having a decomposition half-life in the range of above 4 to 225 hours at pH 10, said inhibitor after decomposition having substantially no photographic inhibitor properties, the compound having the formula:

$$CAR—(TIME)_n—INH—L—Y \quad (I).$$

29 Claims, No Drawings

DIR COUPLERS WITH HYDROLYZABLE INHIBITORS FOR USE IN HIGH PH PROCESSED FILMS

BACKGROUND OF THE INVENTION

This invention relates to a photographic light-sensitive material, such as a color reversal material, designed for processing in a high pH developer solution. In particular, the photographic light-sensitive material contains a novel development inhibiting releasing (DIR) compound capable of releasing a development inhibitor, or precursor thereof, upon the reaction with the oxidation product of a developing agent. The development inhibitor is designed to be decomposed upon diffusion into the high pH developer solution. The invention can be used in graphic arts photography as well as color reversal photography.

Hydrolyzable inhibitor type DIR couplers have proved useful in color negative processes in that the released inhibitor can diffuse within the film to exert its development inhibiting function. However, when the inhibitor enters the color developing solution, the inhibitor hydrolyzes to a compound that has little or no development inhibiting properties, such that the product of hydrolysis has no influence on the development of subsequent films processed in the same developer solution. If the half-life value of decomposition of the inhibitor is too short, the inhibitor can decompose in the film when it contacts the developing solution to such an extent that it does not exert the desired inhibition of development. Likewise, if the half-life value of decomposition is too long, the inhibitor may not decompose in a timely fashion in the developer and may exert a deleterious influence on the development of subsequent films processed in the same developer solution.

U.S. Pat. No. 4,477,563 discloses development inhibitor molecules that are converted into an inactive species (with respect to development inhibition) soon after contact with the processing solution.

U.S. Pat. No. 4,782,012 discloses preferred hydrolyzable mercaptotetrazole inhibitors; however, these inhibitors are ineffective in films processed in high pH processes. U.S. Pat. No. 4,782,012 discloses that the logarithm of the partition coefficient (Log P) is a good measure of the strength of the inhibitor, its mobility and, thus, its ability to provide inter-image effects. Further it discloses that the calculated Log P (c Log P) is used to identify optimal solubility values for mercaptotetrazole inhibitors. Log P is the logarithm of the partition coefficient of a species between a standard organic phase, usually octanol, and an aqueous phase, usually water. Color photographic elements are polyphasic systems, and a photographic inhibitor released in such a system can partition between these various phases. Log P serves as a measure of this partitioning and can be correlated to desirable inhibitor properties such as inhibition strength and inter-image effects.

Inhibitor moieties with c Log P values below 0.40 have been found to be too weak as inhibitors in the present invention and have no useful inter-image properties. The c Log P values used in this specification are, unless otherwise indicated, calculated using the additive fragment techniques of C. Hansch and A. Leo as described in "Substituent Constants for Correlation Analysis in Chemistry and Biology", Wiley, New York, 1979, using the computer program "MedChem", version 3.54, Medicinal Chemistry Project, Pomona College, Claremont, Calif. (1989).

U.S. Pat. Nos. 4,937,179 and 5,004,677 and European Application No. 488,310 describe DIR couplers containing hydrolyzable inhibitors and teach a preferred half-life period of the inhibitor at pH 10.0 of not more than four hours.

Japanese Published Application No. 2,251,950 discloses silver halide based, color photographic material containing carboxyester-substituted mercaptooxadiazole and mercaptothiadiazole fragments.

European Application No. 440,466 describes a silver halide photographic material containing couplers that release hydrolyzable mercaptooxadiazole development restrainers.

Thus, it will be seen that the art only teaches a preferred half-life period of the inhibitor at pH 10.0 of not more than four hours. Compounds described in the art have not been designed for films processed through high pH processes (pH$>$11.4).

Thus, great need exists in photographic materials processed in high pH developers, such as color reversal photographic silver halide elements, to provide enhanced inter-image effects or acutance or sharpness advantages by the use of image modifying chemistry without detrimental contamination of the high pH developer solution arising from infusion of development inhibitors released from DIR compounds during processing.

The present invention fulfills this need and overcomes the problems relating to the use of DIR compounds or couplers in films processed in high pH developers, such as color reversal photographic silver halide elements, by providing an improved film element comprising:

a silver halide photographic light-sensitive material for development in a development solution at a pH of at least 11.4, the material comprising a support having a silver halide emulsion layer comprising a compound capable of releasing a development inhibitor having a decomposition half-life in the range of above 4 to 225 hours, preferably 6 to 120 hours at pH 10, said inhibitor after decomposition having no or substantially much weaker photographic inhibitor properties, the compound having the formula:

$$\text{CAR—(TIME)}_n\text{—INH—L—Y} \qquad \text{(I)}$$

wherein:

CAR is a carrier moiety releasing —(TIME)$_n$—INH—L—Y by reaction with oxidized developer;

TIME is a timing group;

INH—L—Y is a development inhibitor moiety selected from the group consisting of oxazole, thiazole, diazole, oxathiazole, triazole, thiatriazole, tetrazole, benzimidazole, indazole, isoindazole, mercaptothiazole, mercaptotriazole, mercaptothiadiazole, mercaptotetrazole, selenotetrazole, mercaptooxadiazole, selenobenzothiazole, mercaptobenzoxazole, selenobenzoxazole, mercaptobenzimidazole, selenobenzimidazole, benzodiazole, or benzisodiazole such that an inhibitor moiety comprising H—INH—L—Y has a calculated log P of greater than 0.4;

n is 0, 1 or 2;

L is a connecting group containing a chemical bond which is broken in a photographic developing solution and includes the following: —$CO_2$—, —$NR_eCO_2$—, —$SO_2O$—, —$OCH_2CH_2SO_2$—, —OC(=O)O—, or —$NR_eC(=O)C(=O)$—, where $R_e$ is hydrogen, an alkyl group, an alkenyl group, an aryl group, or a heterocyclic group; and L can be incorporated into INH—L—Y such that either end of L (as drawn above) can be attached to INH;

Y represents an alkyl group, an alkenyl group, an aryl group, or a heterocyclic group. When Y is an alkyl group, the alkyl group may be substituted or unsubstituted or straight or branched chain or cyclic. Y may contain from 1 to 5 alkylthio groups. The total number of carbons in Y is 1 to 25. The alkyl group may in turn be substituted by the same groups listed for R below. When the Y group is an aryl group, the aryl group may be substituted by the same groups listed for R. When Y is a heterocyclic group, the heterocyclic group is a 5- or 6-membered monocyclic or condensed ring containing as a heteroatom a nitrogen atom, oxygen atom, or a sulfur atom. Examples are a pyridyl group, a quinolyl group, a furyl group, a benzothiazolyl group, an oxazolyl group, an imidazolyl group, a thiazolyl group, a triazolyl group, a benzotriazolyl group, an imido group and an oxazine group. The heterocyclic group may be substituted by the same groups listed for R. Other INH—L—Y moieties can include benzotriazoles or mercaptobenzothiazoles.

Linking or timing groups, when present, are groups such as esters, carbamates, and the like that undergo base-catalyzed cleavage, including anchimerically assisted hydrolysis or intramolecular nucleophilic displacement. Suitable linking groups, which are also known as timing groups, are shown in U.S. Pat. No. 5,151,343 and in U.S. Pat. Nos. 4,857,447, 5,021,322, 5,026,628, and 5,051,345, all incorporated herein by reference. Preferred linking groups are o- and p-hydroxymethylene moieties, as illustrated in the previously mentioned U.S. Pat. No. 5,151,343 and in Couplers T16 and T1, respectively, of the instant application, and o-hydroxyphenyl substituted carbamate groups.

CAR groups includes couplers which react with oxidized color developer to form dyes while simultaneously releasing development inhibitors or inhibitor precursors. Other suitable carrier groups include hydroquinones, catechols, aminophenols, aminonaphthols, sulfonamidophenols, pyrogallols, sulfonamidonaphthols, and hydrazides that undergo cross-oxidation by oxidized color developers. DIR compounds with carriers of these types are disclosed in U.S. Pat. No. 4,791,049, incorporated herein by reference. Preferred CAR groups are couplers that yield unballasted dyes which are removed from the photographic element during processing, such as those disclosed in the previously mentioned U.S. Pat. No. 5,151,343. Further, preferred carrier groups are couplers that yield ballasted dyes which match spectral absorption characteristics of the image dye and couplers that form colorless products.

In one embodiment of the invention, a three-color reversal element has the following schematic structure:

(13) Second protective layer containing matte
(12) First protective layer containing UV-absorbing dyes
(11) Fast blue-sensitive layer containing blue-sensitive emulsion and yellow coupler
(10) Slow blue-sensitive layer containing blue-sensitive emulsion and yellow coupler
(9) Yellow filter layer
(8) Intermediate layer
(7) Fast green-sensitive layer containing green-sensitive emulsion and magenta coupler
(6) Slow green-sensitive layer containing green-sensitive emulsion and magenta coupler
(5) Intermediate layer
(4) Fast red-sensitive layer containing red-sensitive emulsion and cyan coupler
(3) Slow red-sensitive layer containing red-sensitive emulsion and cyan coupler
(2) Intermediate layer
(1) Antihalation layer
Support with subbing layer In the following discussion of suitable materials for use in the emulsions and elements of this invention, reference will be made to *Research Disclosure,* December, 1989, Item 308119, published by Kenneth Mason Publications, Ltd., Dudley Annex, 12a North Street, Emsworth, Hampshire, P010 7DQ, UK, the disclosures of which are incorporated herein by reference. This publication will be identified hereafter by the term *Research Disclosure.*

Couplers which form cyan dyes upon reaction with oxidized color-developing agents are described in such representative patents and publications as U.S. Pat. Nos. 2,772,162; 2,895,826; 3,002,836; 3,034,892; 2,747,293; 2,423,730; 2,367,531; 3,041,236; and 4,333,999; and Research Disclosure, Section VII D. Preferably, such couplers are phenols and naphthols.

Couplers which form magenta dyes upon reaction with oxidized color developing agents are described in such representative patents and publications as: U.S. Pat. Nos. 2,600,788; 2,369,489; 2,343,703; 2,311,082; 3,152,896; 3,519,429; 3,062,653; and 2,908,573; and *Research Disclosure,* Section VII D. Preferably, such couplers are pyrazolones and pyrazolotriazoles.

Couplers which form yellow dyes upon reaction with oxidized and color developing agents are described in such representative patents and publications as: U.S. Pat. Nos. 2,875,057; 2,407,210; 3,265,506; 2,298,443; 3,048,194; and 3,447,928; and *Research Disclosures,* Section VII D. Preferably, such couplers are acylacetamides such as benzoylacetanilides and pivaloylacetanilides.

Couplers which form colorless products upon reaction with oxidized color developing agents are described in such representative patents as: UK Patent No. 861,138; U.S. Pat. Nos. 3,632,345; 3,928,041; 3,958,993; and 3,961,959. Preferably, such couplers are cyclic carbonyl-containing compounds which react with oxidized color developing agents but do not form dyes.

The image dye-forming couplers can be incorporated in photographic elements and/or in photographic processing solutions, such as developer solutions, so that upon development of an exposed photographic element they will be in reactive association with oxidized color-developing agent. Coupler compounds incorporated in photographic processing solutions should be of such molecular size and configuration that they will diffuse through photographic layers with the processing solution When incorporated in a photographic element, as a general rule, the image dye-forming couplers should be nondiffusible; that is, they should be of such molecular size and configuration that they will not significantly wander from the layer in which they are coated.

Photographic elements of this invention can be processed by conventional techniques in which color-forming couplers and color-developing agents are incorporated in separate processing solutions or compositions or in the element, as described in *Research Disclosure*, Section XIX.

High pH processes as described in this invention include the E-6 process as described in *Manual For Processing Kodak Ektachrome Films Using E-7*, (1980) *Eastman Kodak Company, Rochester, N.Y.*, or a substantially equivalent process made available by a company other than Eastman Kodak Company. These processes are referred to as "current" color reversal processes or "standard" processes. In these processes the pH of the color developer solution is from about 11.6 to about 12.1. The color developer solution is used in the process for about from 5.5 to 7.0 minutes at a temperature of from 36.6 to 39.4 C.

Preferred INH—L—Y groups of the invention can be selected from the groups having the following structures:

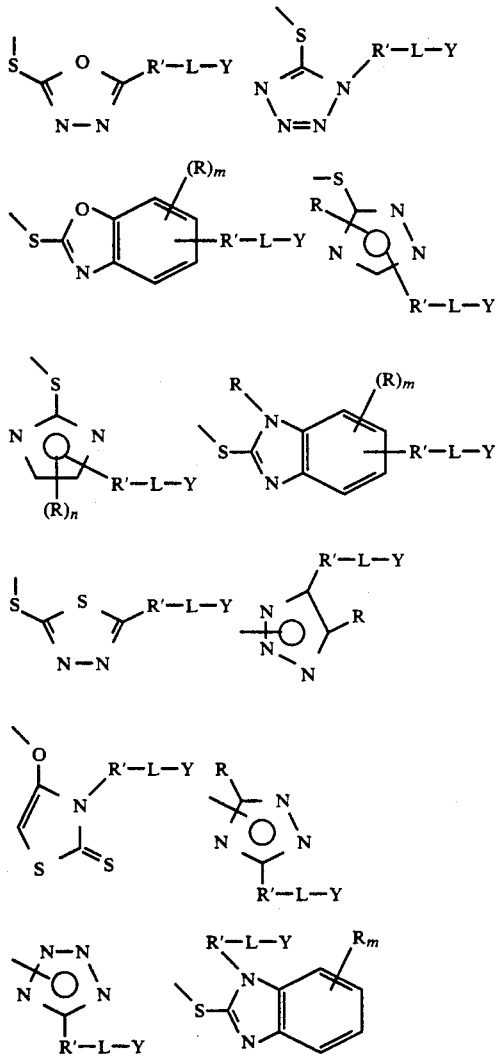

wherein R′ is selected from an alkyl group, an aryl group, or a 5- or 6-membered heterocyclic ring, alkoxy group, aryloxy group, alkoxycarbonyl group, aryloxycarbonyl group, amino group, sulfamoyl group, sulfonamido group, sulfoxyl group, carbamoyl group, alkylsulfo group, arylsulfo group, aryloxycarbonylamino group, alkoxycarbonylamino group, acylamino group, ureido group, arylthio group, alkylthio group. When R′ is an alkyl group, the alkyl group may be substituted or unsubstituted or straight or branched chain or cyclic. The R′ group may contain from 1 to 5 alkylthio groups. total number of carbons in R′ is 1 to 25. The alkyl group may in turn be substituted by R, where R can be selected from those listed from R′ above, but may also be selected from hydrogen, halogen (including fluorine, chlorine, bromine and iodine), hydroxy group, or cyano group. When the R′ group is an aryl group, the aryl group may be substituted by the same groups listed for R. When R′ is a heterocyclic group, the heterocyclic group is a 5- or 6-membered monocyclic or condensed ring containing as a heteroatom a nitrogen atom, oxygen atom, or a sulfur atom. Examples are a pyridyl group, a quinolyl group, a furyl group, a benzothiazolyl group, an oxazolyl group, an imidazolyl group, a thiazolyl group, a triazolyl group, a benzotriazolyl group, an imido group and an oxazine group. The heterocyclic group may be substituted by the same groups listed for R. When there are two or more R groups on a molecule, R may be the same or different; n can be 0, 1 or 2 and m can be 0, 1, 2 or 3.

Further preferred INH—L—Y groups are selected from, but are not limited to the following examples:

Q1

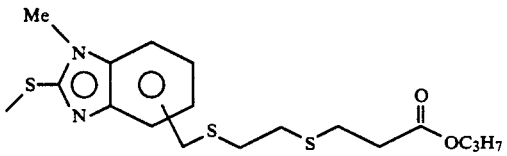

Q2

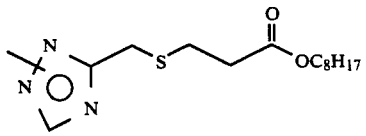

Q3

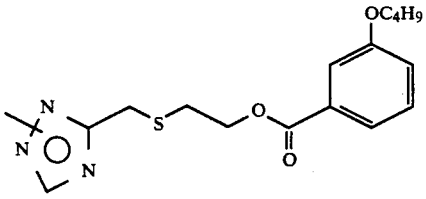

Q4

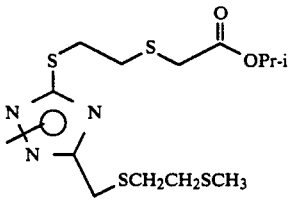

Q5

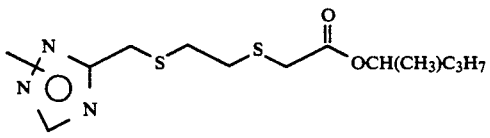

Q6

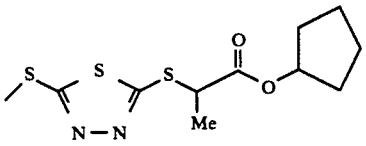

-continued
Q7
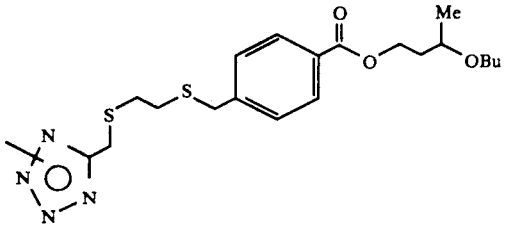
Q8
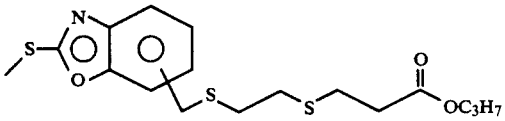
Q9
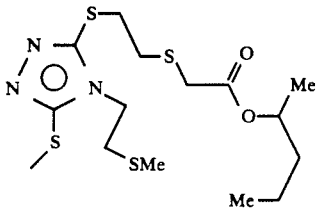
Q10
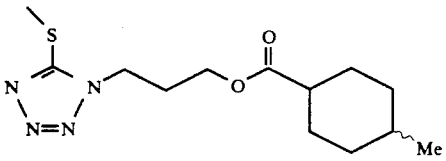
Q11
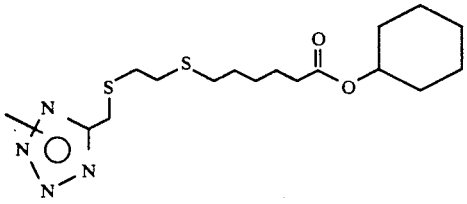
Q12
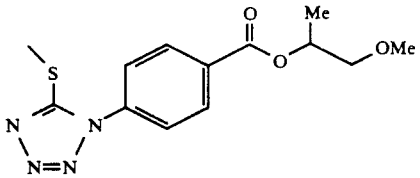
Q13
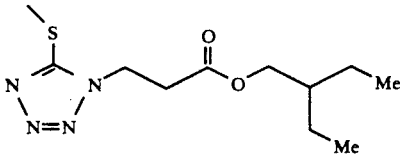
Q14
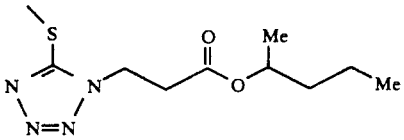
-continued
Q15
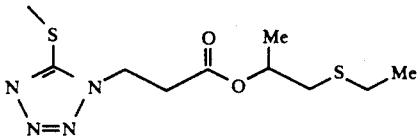
Q16
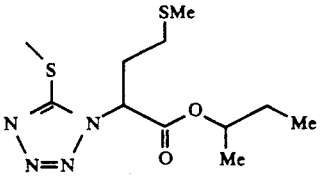
Q17
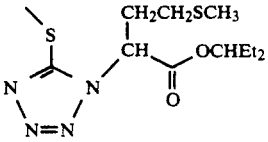
Q18
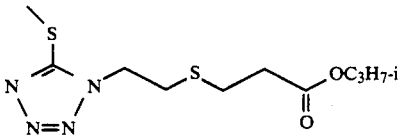
Q19
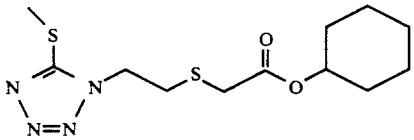
Q20
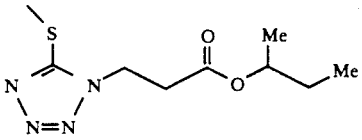
Q21
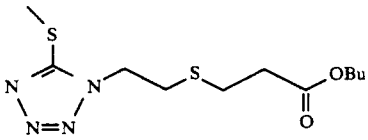
Q22
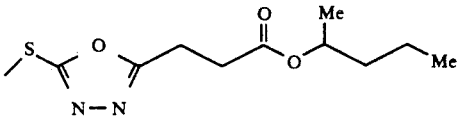
Q23
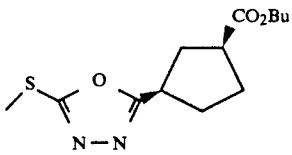
Q24
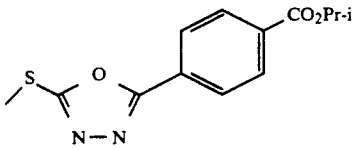

-continued

Q25

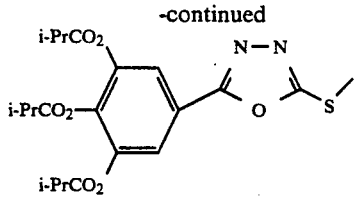

Q26

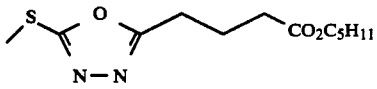

Q27

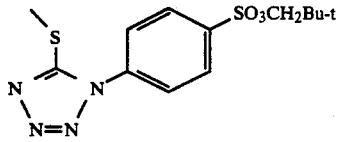

Q28

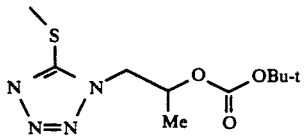

Q29

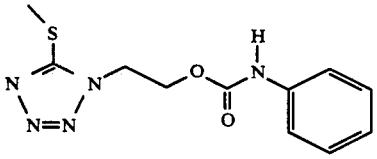

Q30

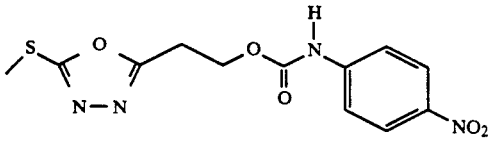

Q31

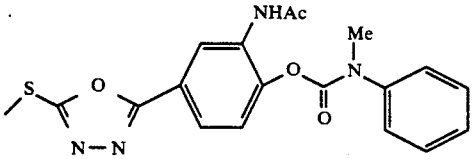

Q32

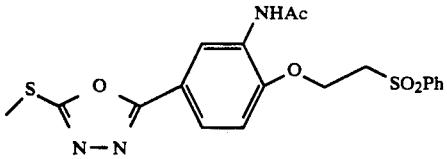

Preferably CAR is a coupler moiety and further the coupler moiety may be ballasted.

In the element in accordance with the invention the —(TIME)$_n$—INH—L—Y group is bonded to a coupling position of the coupler moiety.

Preferably CAR is unballasted and at least one TIME moiety attached to CAR is ballasted and CAR is preferably a coupler moiety.

Further, preferably CAR is a moiety which can cross-oxidize with oxidized color developer, and may be selected from the class consisting of hydrazides and hydroquinones.

The compound (I) may be present in the element from 0.5 to about 30 mg/ft$^2$ (0.005 to 0.3g/m$^2$)and typically is present in the element from about 1 to about 10 mg/ft$^2$ (0.01 to 0.1 g/m$^2$).

CAR can, for example, be a coupler residue, designated COUP, which forms a dye as a part of a coupling reaction, or an organic residue which forms no dye. The purpose of CAR is to furnish, as a function of color development, a fragment INH—L—Y, or INH—L—Y linked to a linking group or timing group or to a combination of linking and timing groups, designated —(TIME)$_n$—. So long as it performs that function in an efficient manner, it has accomplished its purpose for this invention.

When COUP is a yellow coupler residue, coupler residues having general formulas II–IV are preferred. When COUP is a magenta coupler residue, it is preferred that COUP have formula (V) or (VIII). When COUP is a cyan coupler residue, it is preferred that COUP have the formula represented by general formulas (VI) and (VII).

Furthermore, CAR may be a redox residue, which is a group capable of being cross oxidized with an oxidation product of a developing agent. Such carriers may be hydroquinones, catechols, pyrogallols, aminonaphthols, aminophenols, naphthohydroquinones, sulfonamidophenols, hydrazides, and the like. Compounds with carriers of these types are disclosed in U.S. Pat. No. 4,791,049. Preferred CAR fragments of this type are represented by general formulas (X) and (XI). Compounds within formulas (IX) and (XII) are compounds that react with oxidized developer to form a colorless product or a dye which decolorizes by further reaction.

So long as the film has an image modifying compound of the type described herein, in one image forming layer, the film is as described for this invention. It is to be understood, however, that the film may have two or more described image modifying compounds in an image forming silver halide emulsion layer, or that two or more such layers may have one or more described image modifying compounds.

In general compound (I) is represented by, for example, the following structures:

II

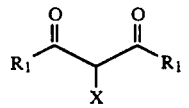

III

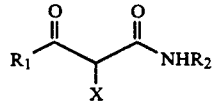

IV

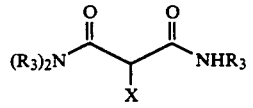

V

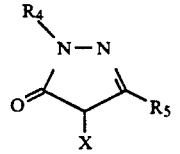

-continued

VI

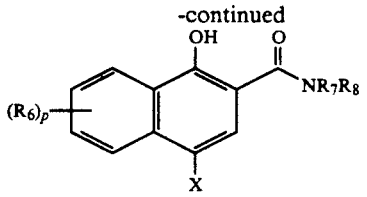

VII

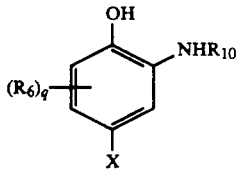

VIII

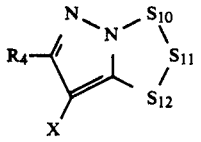

IX

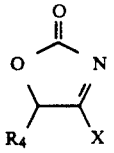

X

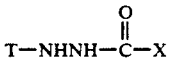

XI

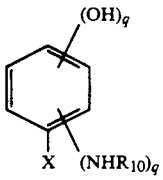

XII

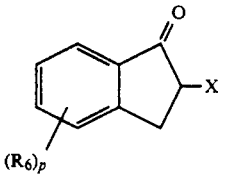

In the foregoing compounds, X=—(TIME)$_n$—INH—L—Y, and $R_1$ represents an aliphatic group, an aromatic group, an alkoxy group, or a heterocyclic ring, and $R_2$ and $R_3$ are each a hydrogen, an aromatic group, an aliphatic group or a heterocyclic ring. The aliphatic group represented by $R_1$ preferably contains from 1 to 30 carbon atoms, and may be substituted or unsubstituted, straight or branched chain, or cyclic. Preferred substituents for an alkyl group include an alkoxy group, an aryloxy group, an amino group, an acylamino group, and a halogen atom. These substituents per se may be substituted. Suitable examples of aliphatic groups represented by $R_1$, $R_2$ and $R_3$ are as follows: an isopropyl group, an isobutyl group a tert-butyl group, an isoamyl group, a tert-amyl group, a 1,1-dimethylbutyl group, a 1,1-dimethylhexyl group, a 1,1-diethylhexyl group, a dodecyl group, a hexadecyl group, an octadecyl group, a cyclohexyl group, a 2-methoxyisopropyl group, a 2-phenoxyisopropyl group, a 2-p-tert-butylphenoxyisopropyl group, an α-aminoisopropyl group, an α-(diethylamino)isopropyl group, an α-(succinimido)isopropyl group, an α-(phthalimido)-isopropyl group, and an α-(benzenesulfonamido)isopropyl group. When two $R_1$ or $R_3$ groups appear, they may be alike or different.

When $R_1$, $R_2$ or $R_3$ represents an aromatic group (particularly a phenyl group), the aromatic group may be substituted or unsubstituted. That is, the phenyl group can be employed per se or may be substituted by a group containing 32 or less carbon atoms, e.g., an alkyl group, an alkenyl group, an alkoxy group, an alkoxycarbonyl group, an alkoxycarbonylamino group, an aliphatic amido group, an alkylsulfamoyl group, an alkylsulfonamido group, an acylureido group, and an alkyl-substituted succinimido group. This alkyl group may contain an aromatic group, e.g., phenylene, in the chain thereof. The phenyl group may also be substituted by, e.g., an aryloxy group, an aryloxycarbonyl group, an arylcarbamoyl group, an arylamido group, an arylsulfamoyl group, an arylsulfonamido group, or an arylureido group. In these subtituents, the aryl group portion may be further substituted by at least one alkyl group containing from 1 to 22 carbon atoms in total.

The phenyl group represented by $R_1$, $R_2$, or $R_3$ may be substituted by an amino group which may be further substituted by a lower alkyl group containing from 1 to 6 carbon atoms, a hydroxyl group, a carboxyl group, a sulfo group, a nitro group, a cyano group, a thiocyano group, or a halogen atom.

In addition, $R_1$, $R_2$ or $R_3$ may further represent a substituent resulting from condensation of a phenyl group with another ring, e.g., a naphthyl group, a quinolyl group, an isoquinolyl group, a furanyl group, a cumaranyl group, and a tetrahydronaphthyl group. These substituents per se may be further substituted.

When $R_1$ represents an alkoxy group, the alkyl portion of the alkoxy group contains from 1 to 40 carbon atoms and preferably from 1 to 22 carbon atoms, and is a straight or branched alkyl group, a straight or branched alkenyl group, a cyclic alkyl group, or a cyclic alkenyl group. These groups may be substituted by, e.g., a halogen atom, an aryl group or an alkoxy group.

When $R_1$, $R_2$ or $R_3$ represents a heterocyclic ring, the heterocyclic ring is bound through one of the carbon atoms in the ring to the carbon atom of the carbonyl group of the acyl group in α-acylacetamide, or to the nitrogen atom of the amido group in α-acylacetamide. Examples of such heterocyclic rings are thiophene, furan, pyran, pyrrole, pyrazole, pyridine, piperidine, pyrimidine, pyridazine, indolizine, imidazole, thiazole, oxazole, triazine, thiazine and oxazine. These heterocyclic rings may have a substituent on the ring thereof.

In structure (V), $R_4$ contains from 1 to 40 carbon atoms, preferably from 1 to 30 carbon atoms, and is a straight or branched alkyl group (e.g., methyl, isopropyl, tert-butyl, hexyl and dodecyl), an alkenyl group (e.g., an allyl group), a cyclic alkyl group (e.g., a cyclopentyl group, a cyclohexyl group and a norbornyl group), an aralkyl group (e g., a benzyl group and a β-phenylethyl group), or a cyclic alkenyl group (e.g., a cyclopentenyl group and a cyclohexenyl group). These groups may be substituted by, e.g., a halogen atom, a nitro group, a cyano group, an aryl group, an alkoxy group, an aryloxy group, a carboxyl group, an alkylthiocarbonyl group, an arylthiocarbonyl group, an alkoxycarbonyl group, an aryloxycarbonyl group, a sulfo group, a sulfamoyl group, a carbamoyl group, an acylamino group, a diacylamino group, a ureido group, a urethane group, a thiourethane group, a sulfonamido group, a heterocyclic group, an arylsulfonyl group, an alkylsulfonyl group, an arylthio group, an alkylthio group, an alkylamino group, a dialkylamino group, an anilino group, an N-arylanilino group, an N-alkylanilino group, an N-acylanilino group, a hydroxyl group and a mercapto group.

$R_4$ may further represent an aryl group, e.g a phenyl group, and an α- or β-naphthyl group. This aryl group contains at least one substituent. These substituents include an alkyl group, an alkenyl group, a cyclic alkyl group, an aralkyl group, a cyclic alkenyl group, a halogen atom, a nitro group, a cyano group, an aryl group, an alkoxy group, an aryloxy group, a carboxyl group, an alkoxycarbonyl group, an aryloxycarbonyl group, a sulfo group, a sulfamoyl group, a carbamoyl group, an acylamino group, a diacylamino group, a ureido group, a urethane group, a sulfonamido group, a heterocyclic group, an arylsulfonyl group, an alkylsulfonyl group, an arylthio group, an alkylthio group, an alkylamino group, a dialkylamino group, an anilino group, an N-alkylanilino group, an N-arylanilino group, an N-acylanilino group, a hydroxyl group and a mercapto group.

More preferably, $R_4$, is a phenyl group which is substituted by, e.g., an alkyl group, an alkoxy group or a halogen atom, in at least one of the ortho positions.

$R_4$ may further represent a heterocyclic ring (e.g., 5- or 6-membered heterocyclic or condensed heterocyclic group containing a nitrogen atom, an oxygen atom or a sulfur atom as a hetero atom, such as a pyridyl group, a quinolyl group, a furyl group, a benzothiazolyl group, an oxazolyl group, an imidazolyl group and a naphthoxazolyl group), a heterocyclic ring substituted by the groups described for the aryl group as described above, an aliphatic or aromatic acyl group, an alkylsulfonyl group, an arylsulfonyl group, an alkylcarbamoyl group, an arylcarbamoyl group, an alkylthiocarbamoyl group or an arylthiocarbamoyl group.

$R_5$ is a hydrogen atom, a straight or branched alkyl group containing from 1 to 40 carbon atoms, preferably from 1 to 30 carbon atoms, an alkenyl group, a cyclic alkyl group, an aralkyl group, a cyclic alkenyl group to which may contain substituents as described for $R_4$), an aryl group and a heterocyclic group (which may contain substituents as described for $R_4$,), an alkoxycarbonyl group (e.g., a methoxycarbonyl group, an ethoxycarbonyl group and a stearyloxycarbonyl group), an aryloxycarbonyl group (e.g., a phenoxycarbonyl group, and a naphthoxycarbonyl group), an aralkyloxycarbonyl group (e.g., a benzyloxycarbonyl group), an alkoxy group (e.g., a methoxy group, an ethoxy group and a heptadecyloxy group), an aryloxy group (e.g., a phenoxy group and a tolyloxy group), an alkylthio group (e.g., an ethylthio group, and a dodecylthio group), an arylthio group (e.g., a phenylthio group and an α-naphthylthio group), a carboxyl group, an acylamino group (e.g., an acetylamino group and a 3-[(2,4-di-tert-amylphenoxy)acetamido]benzamido group), a diacylamino group, an N-alkylacylamino group (e.g., an N-methylproprionamido group), an N-arylacylamino group (e.g., an N-phenylacetamido group), a ureido group (e.g. a ureido group and an N-arylureido group), a urethane group, a thiourethane group, an arylamino group (e.g., a phenylamino group, an N-methylanilino group, a diphenylamino group, an N-acetylanilino group and a 2-chloro-5-tetradecanamidoanilino group), a dialkylamino group (e.g., a dibenzylamino group), an alkylamino group (e.g., an n-butylamino group, a methylamino group and a cyclohexylamino group), a cycloamino group (e.g., a piperidino group and a pyrrolidino group), a heterocyclic amino group (e.g., a 4-piperidylamino group and a 2-benzoxazolylamino group), an alkylcarbonyl group (e.g., a methylcarbonyl group), an arylcarbonyl group (e.g., a phenylcarbonyl group), a sulfonamido group (e.g., an alkylsulfonamido group, and an arylsulfonamido group), a carbamoyl group (e.g., an ethylcarbamoyl group, a dimethylcarbamoyl group, an N-methylphenylcarbamoyl group, and an N-phenylcarbamoyl group), a 4,4'-sulfonyldiphenoxy group, a sulfamoyl group (e.g., an N-alkylsulfamoyl group, an N,N-dialkylsulfamoyl group, an N-arylsulfamoyl group, an N-alkyl-N-arylsulfamoyl group and an N,N-diarylsulfamoyl group), a cyano group, a hydroxyl group, a mercapto group, a halogen atom or a sulfo group.

$R_6$, $R_7$ and $R_8$ each represents groups as used for the usual 4-equivalent type phenol or α-naphthol couplers. In greater detail, $R_6$ is a hydrogen atom, a halogen atom, an aliphatic hydrocarbon residue, an acylamino group, —O—$R_9$ or —S—$R_9$ (wherein $R_9$ is an aliphatic hydrocarbon residue). When there are two or more $R_6$ groups in the same molecule, they may be different. The aliphatic hydrocarbon residue includes those containing a substituent(s). $R_7$ and $R_8$ are each an aliphatic hydrocarbon residue, an aryl group or a heterocyclic residue. One of $R_7$ and $R_8$ may be a hydrogen atom, and the above-described groups for $R_7$ and $R_8$ may be substituted. $R_7$ and $R_8$ may combine together to form a nitrogen-containing heterocyclic nucleus. In the formulas, q is an integer of from 1 to 3, and p is an integer of from 1 to 5.

$R_{11}$ group refers to a hydrogen atom, a halogen atom, an alkyl group, an alkenyl group, an aralkyl group, an alkoxy group, an alkoxycarbonyl group, an anilino group, an acylamino group, a ureido group, a cyano group, a nitro group, a sulfonamido group, a sulfamoyl group, a carbamoyl group, an aryl group, a carboxy group, a sulfo group, a hydroxy group, or an alkanosulfonyl group. The alkyl group on $R_{11}$ contains 1 to 32 carbons. In the general formulae X-XXII, Z is oxygen, nitrogen, or sulfur, and k is an integer of 0 to 2.

$R_{10}$ is an acylamido group represented by $COR_1$, a carbamoyl group represented by $CONHR_7R_8$, a sulfonamido group represented by $SO_2R_1$, or $SO_2NR_7R_8$.

The aliphatic hydrocarbon residue may be saturated or unsaturated, straight, branched or cyclic. Preferred examples are an alkyl group (e.g., a methyl group, an ethyl group, a propyl group, an isopropyl group, a butyl group, a tert-butyl group, an isobutyl group, a dodecyl group, an octadecyl group, a cyclobutyl group, and a cyclohexyl group), and an alkenyl group (e.g., an allyl group, and an octenyl group).

The aryl group includes a phenyl group and a naphthyl group, and typical examples of heterocyclic residues are a pyridinyl group, a quinolyl group, a thienyl group, a piperidyl group and an imidazolyl group. Substituents which may be introduced to these aliphatic hydrocarbon, aryl, and heterocyclic groups include a halogen atom, a nitro group, a hydroxyl group, a carboxyl group, an amino group, a substituted amino group, a sulfo group, an alkyl group, an alkenyl group, an aryl group, a heterocyclic group, an alkoxy group, an aryloxy group, an arylthio group, an arylazo group, an acylamino group, a carbamoyl group, an ester group, an acyl group, an acyloxy group, a sulfonamido group, a sulfamoyl group, a sulfonyl group and a morpholino group.

In compounds (II) to (XXII), the substituents, $R_1$, $R_2$, $R_3$, $R_4$, $R_5$, $R_6$, $R_7$ and $R_8$ may combine together to form symmetrical or asymmetrical composite couplers, or any of the substituents may become a divalent group to form symmetrical or asymmetrical composite couplers.

In compounds VIII: $S_{10}$, $S_{11}$ and $S_{12}$ each represents a methine, a substituted methine, =N—, or —NH—; one of $S_{10}$-$S_{11}$ bond and $S_{11}$-$S_{12}$ bond is a double bond and the other is a single bond; when $S_{11}$-$S_{12}$ is a carbon-carbon double bond, the double bond may be a part of an aromatic ring; the compound of general formula VIII includes the case that it forms a dimer or higher polymer at $R_4$; and also when $S_{10}$, $S_{11}$ or $S_{12}$ is a substituted methine, the compound includes the case that it forms a dimer or higher polymer with the substituted methine. Polymer formation can also take place through the linking group —(TIME)$_n$— in all image modifying compounds employed in this invention.

If $R_1$ through $R_{10}$ of structures II through VIII are a ballast such that the dye which is formed on reaction with oxidized developer remains in the film after processing then the formulae are represented by Type II examples.

Especially preferred are those couplers which undergo a coupling reaction with an oxidation product of a developing agent, releasing a development inhibitor, but do not leave a dye in the film which could cause degradation of the color quality. If $R_1$ through $R_{10}$ of compounds II through VII are not a ballast such that the subsequent dye formed form CAR is not immobilized, and is removed from the film during processing, then the formulae are represented by Type I examples. Also included in these Type I examples are formulae IX, X, XI and XII in which $R_1$ through $R_8$ do represent a ballast, but CAR either forms a colorless product or doesn't form a dye on reaction with oxidized developer (as in the case with compounds XI and XII) or the dye that is formed is decolorized by subsequent reactions in the process (as is the case with compounds IX and XII).

Also preferred structures which would produce the same effects as DIR couplers without leaving a retained dye in the film are those in which CAR is a material capable of undergoing redox reaction with the oxidized product of a developing agent and subsequently releasing a development inhibitor as described in U.S. Pat. No. 4,684,604 and represented by the compound X where T represents a substituted aryl group. T may be represented by phenyl, naphthyl; and heterocyclic aryl rings (e.g. pyridyl) and may be substituted by one or more groups such as alkoxy, alkyl, aryl, halogen, and those groups described as $R_5$.

In the compounds (I), —(TIME)$_n$—INH—L—Y is a group which is not released until after reaction with the oxidized developing agent either through cross oxidization or dye formation.

—(TIME)$_n$— in the compounds (I) is one or more linking or timing groups connected to CAR through a oxygen atom, a nitrogen atom, or a sulfur atom which is capable of releasing INH—L—Y from —(TIME)$_n$—INH—L—Y at the time of development through one or more reaction stages. Suitable examples of these types of groups are found in U.S. Pat. Nos. 4,248,962, 4,409,323, 4,146,396, British Pat. No. 2,096,783, Japanese Patent Application (Opi) Nos. 146828/76 and 56837/82, etc.

Preferred examples of —(TIME)— are those represented by the following examples XIII-XX:

XIII

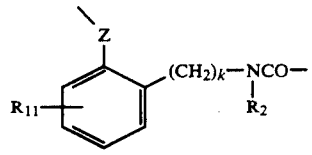

XIV

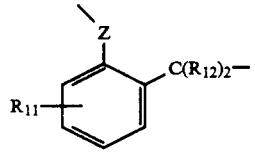

XV

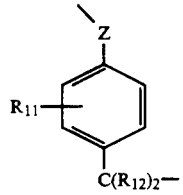

XVI

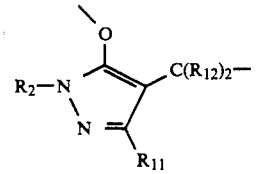

XVII

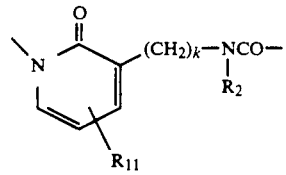

XVIII

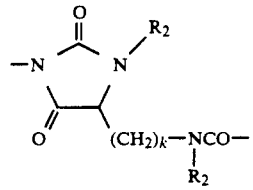

XIX

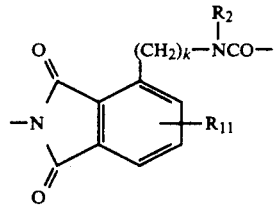

XX

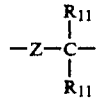

In each of the foregoing compounds, the bond on the left is attached to either CAR or another —(TIME)— moiety, and the bond to the right is attached to INH.

$R_{12}$ is hydrogen, alkyl, perfluoroalkyl, alkoxy, alkylthio, aryl, aryloxy, arylthio, $(R_2)_2N$—, $R_1CONR_7$—, or heterocyclic; $(R_{12})_2$ can complete a non-aromatic heterocyclic or a non-aromatic carbocyclic ring, and $R_{12}$ and $R_{11}$ can complete a non-aromatic heterocyclic or non-aromatic carbocyclic ring.

In timing groups XIII, XIV, XV, and XVII, $R_{11}$ can complete a carbocyclic or heterocyclic ring or ring system. Rings completed include derivatives of naphthalene, quinoline, and the like.

When n=0, —$(TIME)_n$— also represents a single bond such that CAR may be directly joined to INH—L—Y.

For n=2, there can be a combination of any two timing groups mentioned in formulas XIII to XX which still allows the fragmentation and release of INH—L—Y during color development after CAR has reacted with the oxidized developer. The combination of two timing groups may be used to improve the release of the inhibitor fragment INH—L—Y either through rate of release and/or diffusability of —$(TIME)_n$—INH—L—Y or any of its subsequent fragments. For example, preferred structures are:

XXI

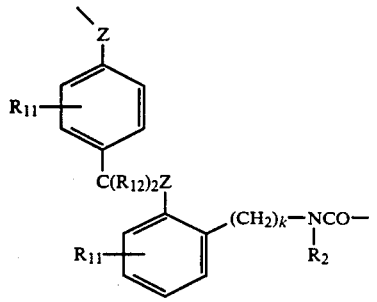

XXII

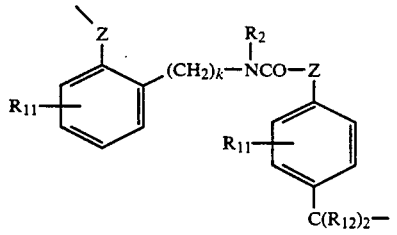

-continued

XXIII

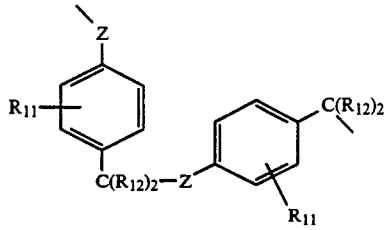

XXIV

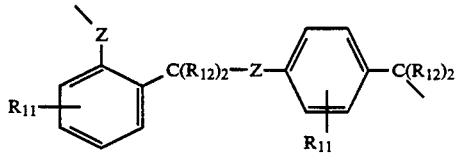

XV

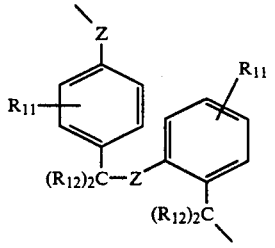

XXVI

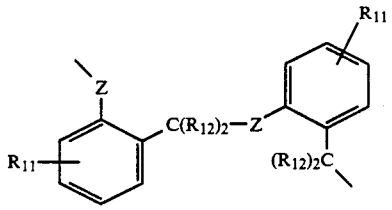

Illustrative but not limiting image modifying compounds which can be employed in this invention are as follows:

T1

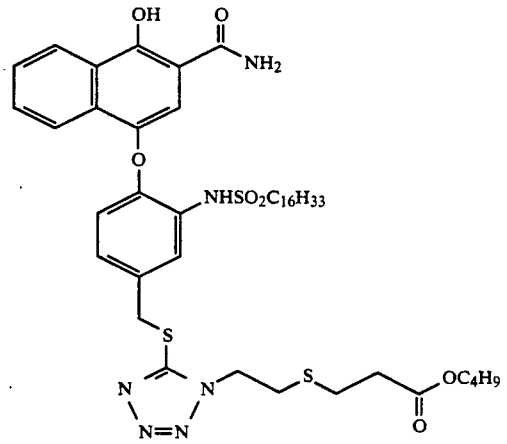

-continued
T2
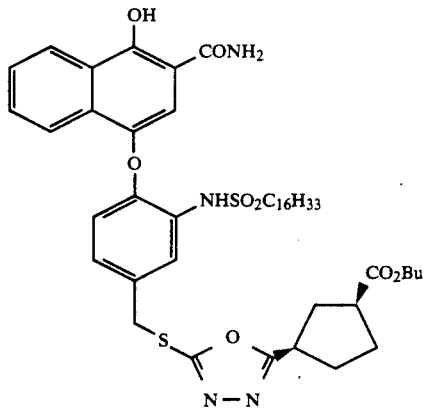
T3
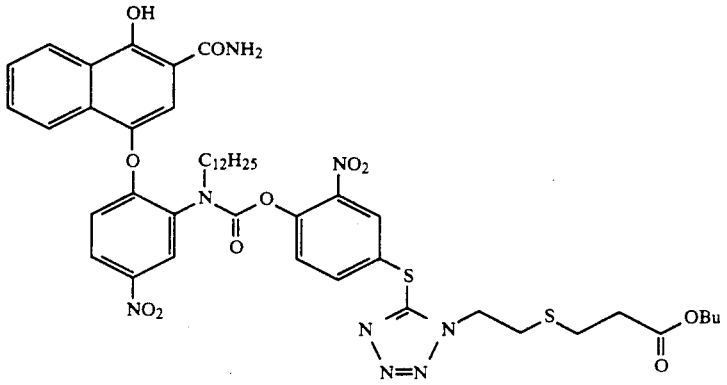
T4
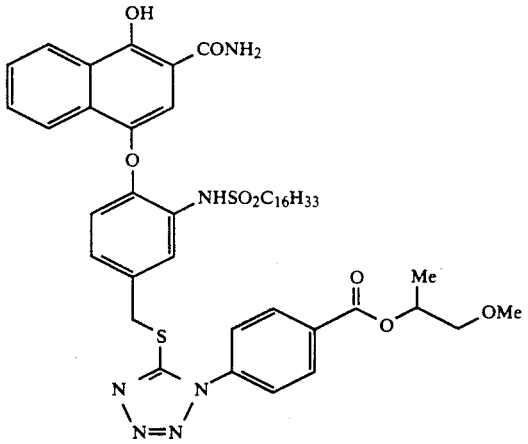
T5
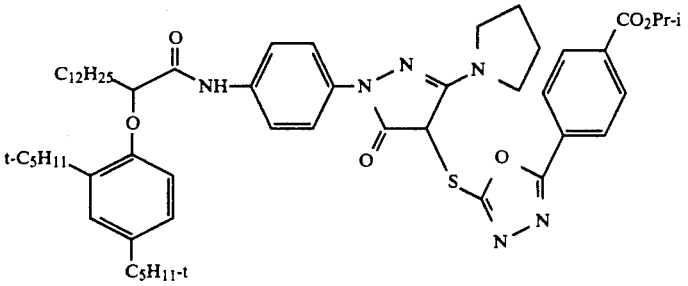

-continued
T6
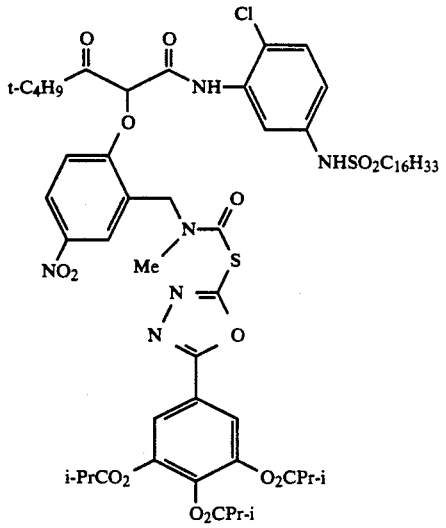
T7
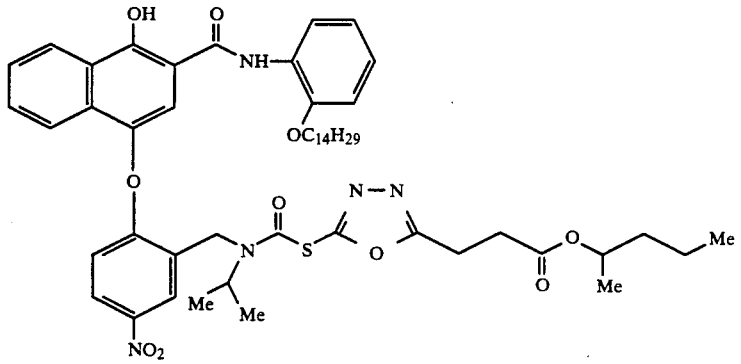
T8
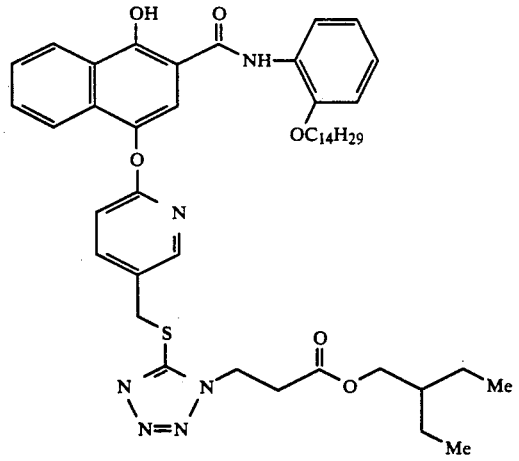
T9
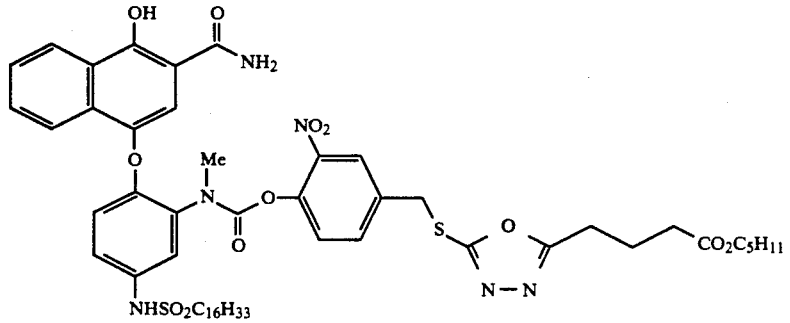

-continued
T-10
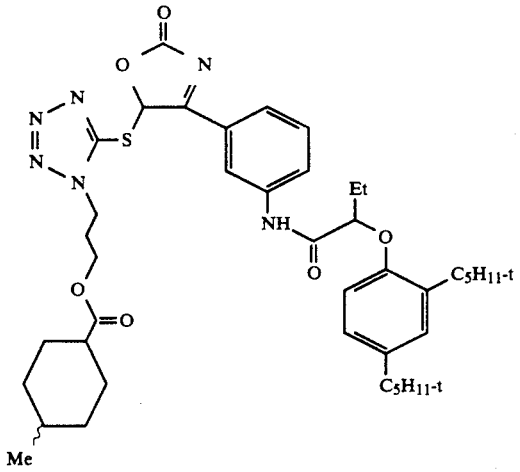
T11
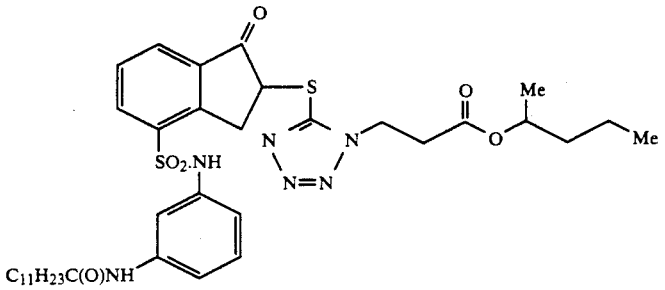
T12
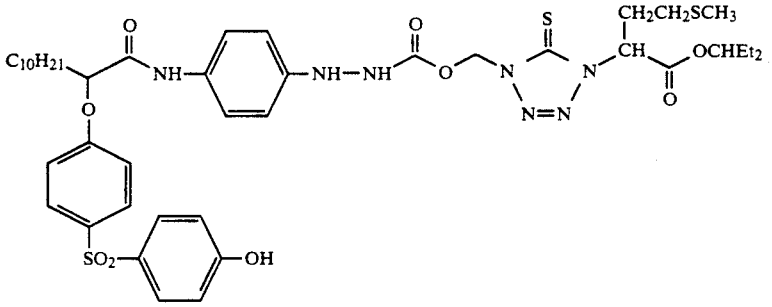
T13
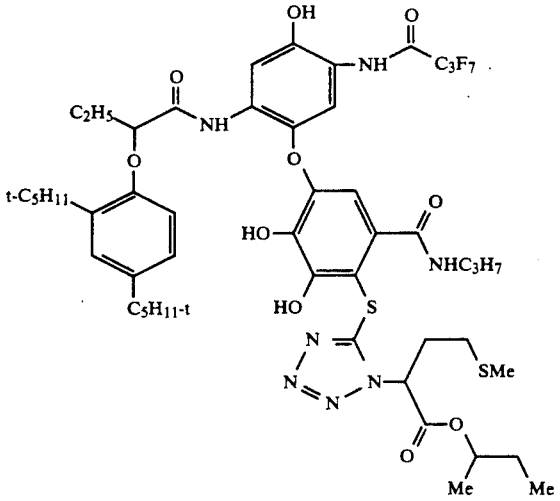

-continued
T14
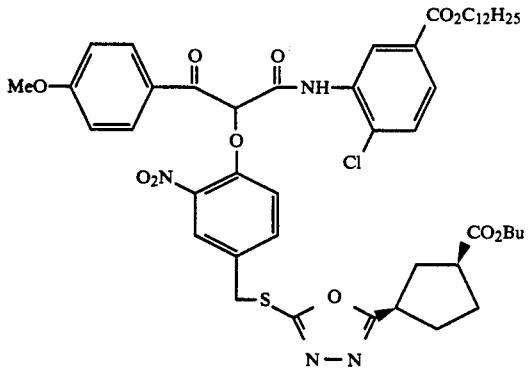
T15
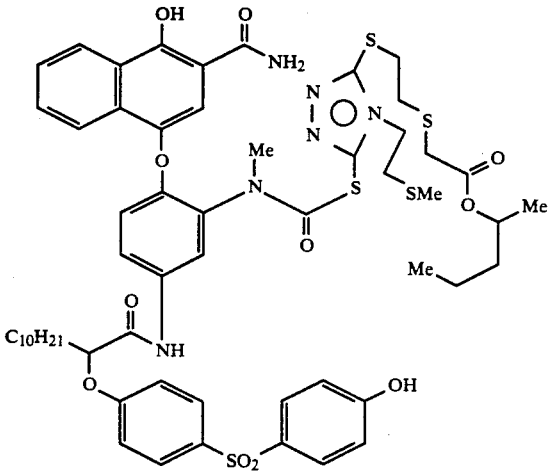
T16
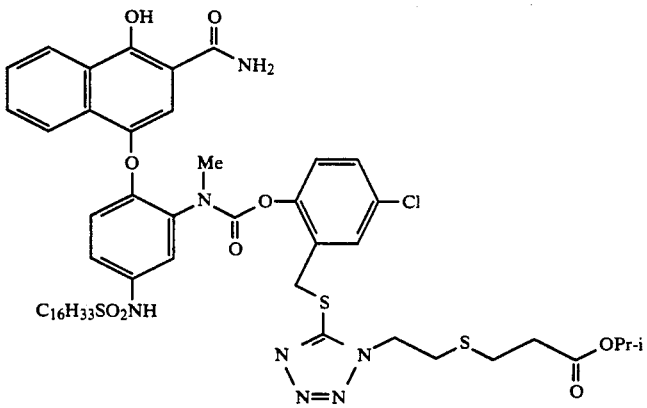
T17
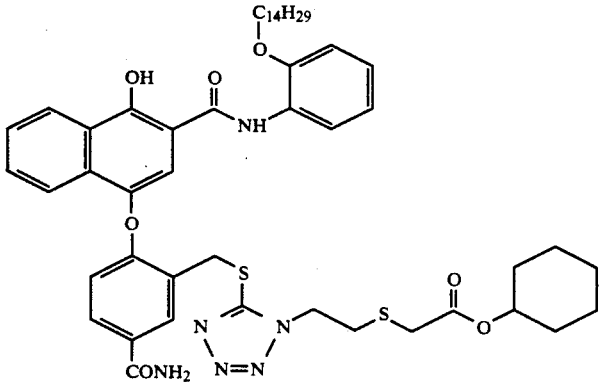

-continued
T18
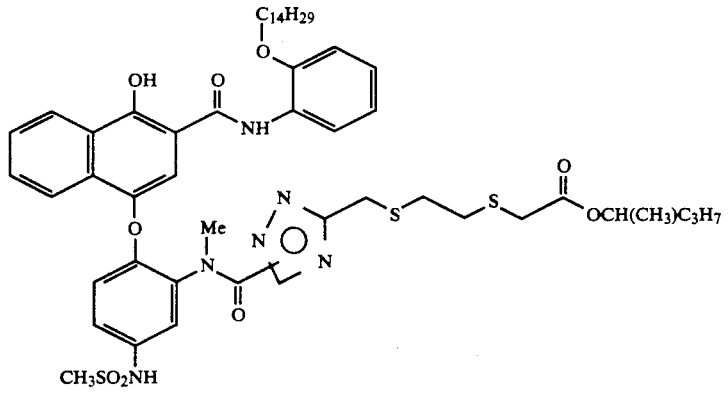
T19
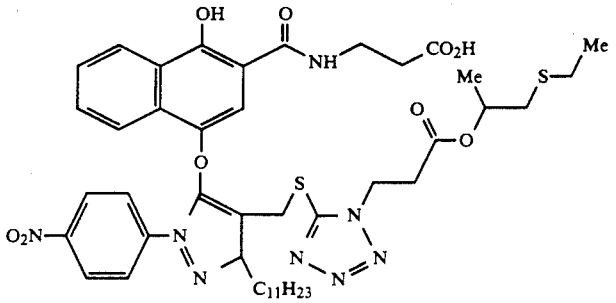
T20
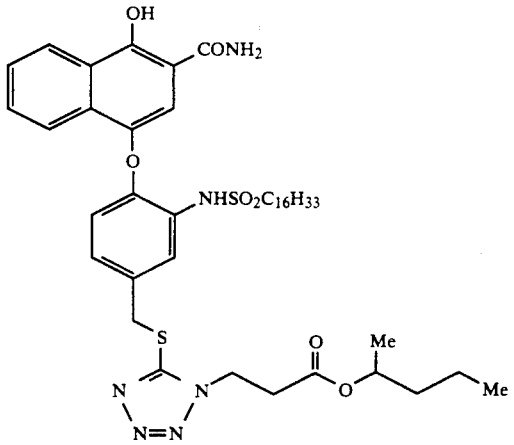
T21
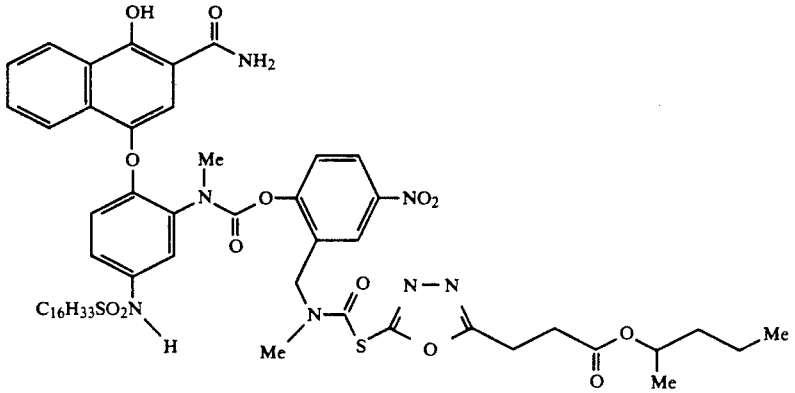

-continued
T22
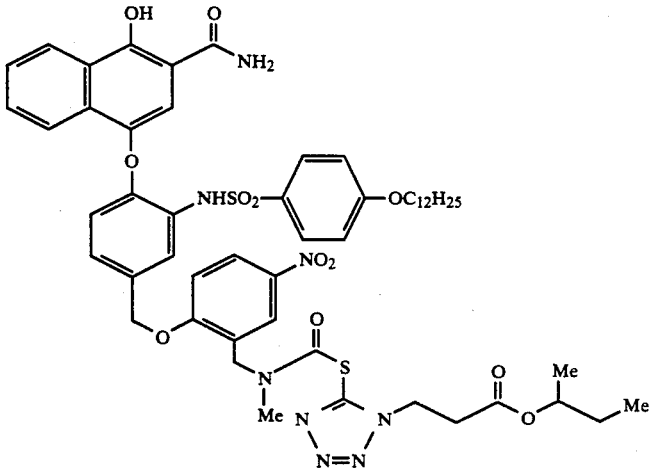
T23
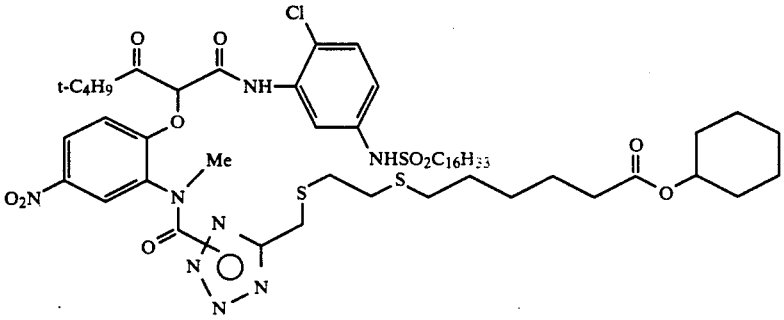
T24
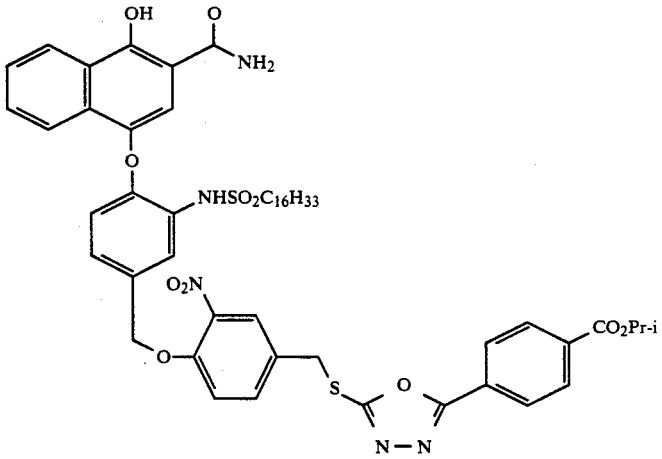
T25
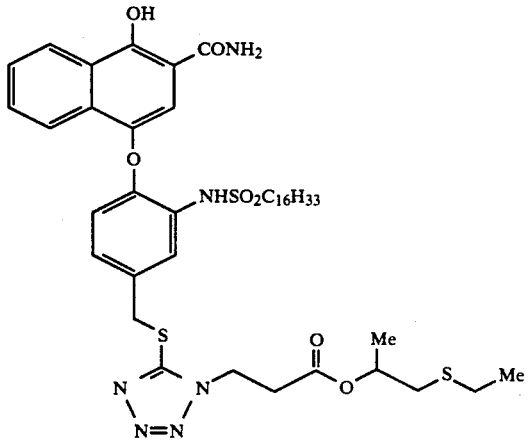

-continued
T26
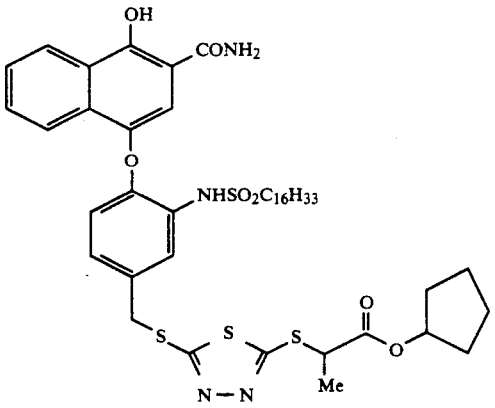
T27
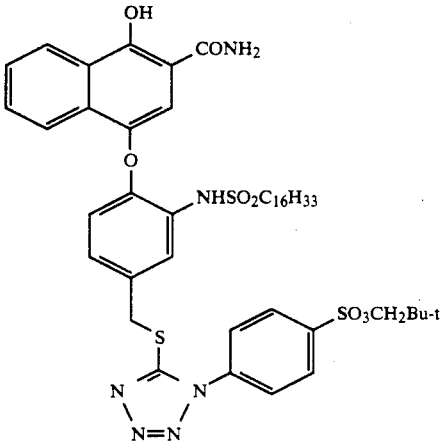
T28
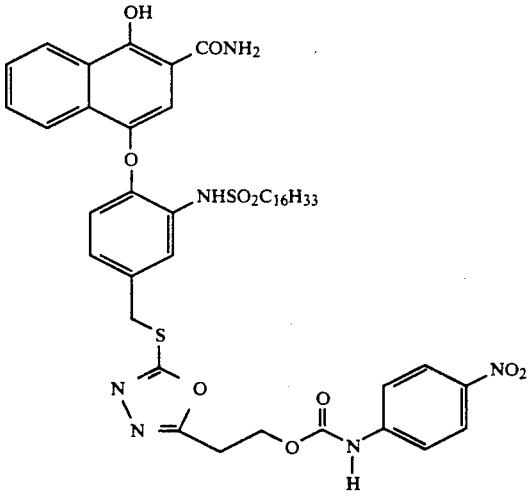
T29
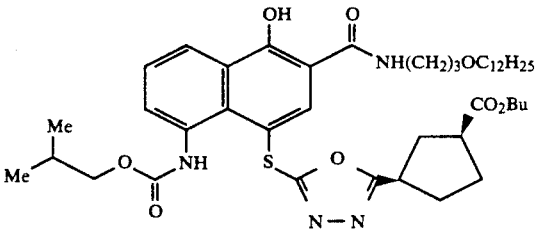

-continued
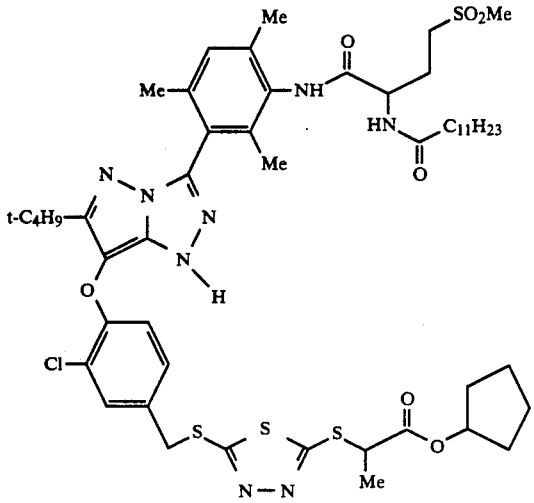
T30
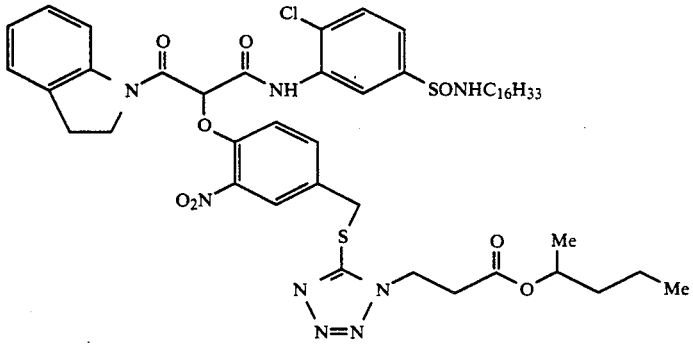
T31
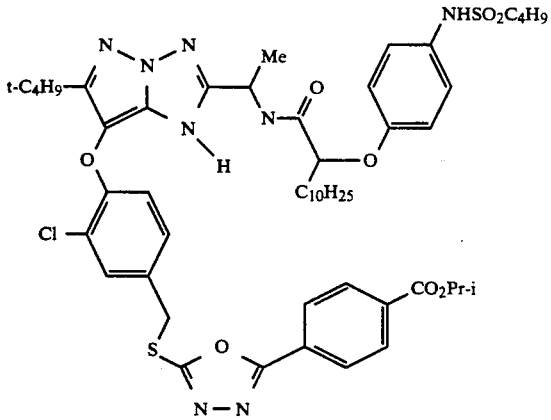
T32

-continued
T33
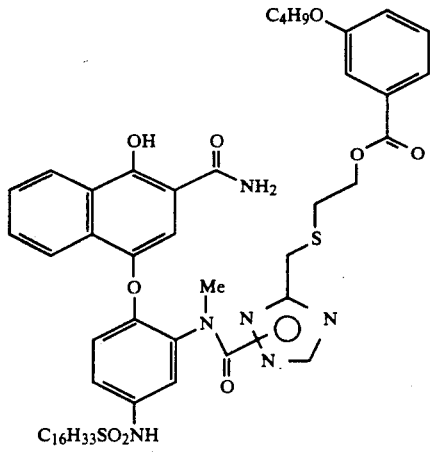
T34
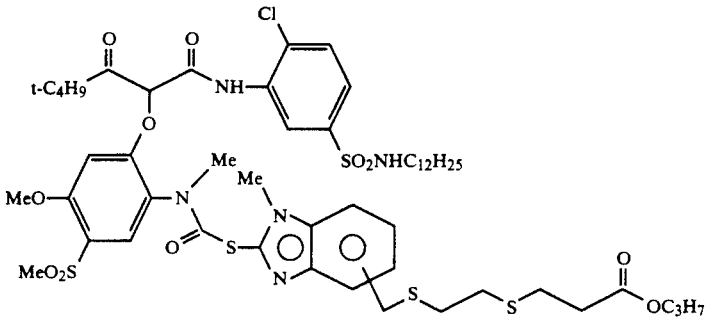
T35
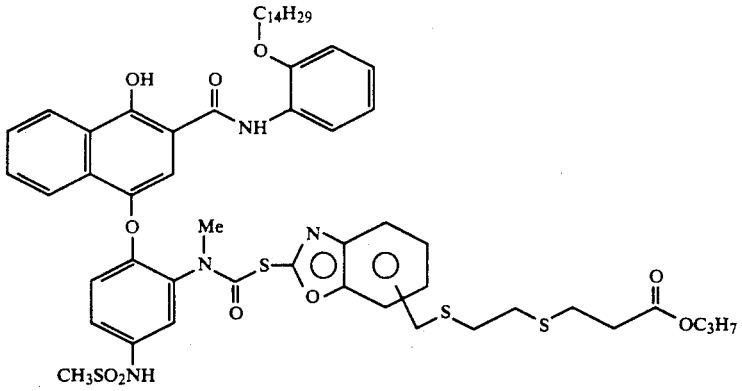
T36
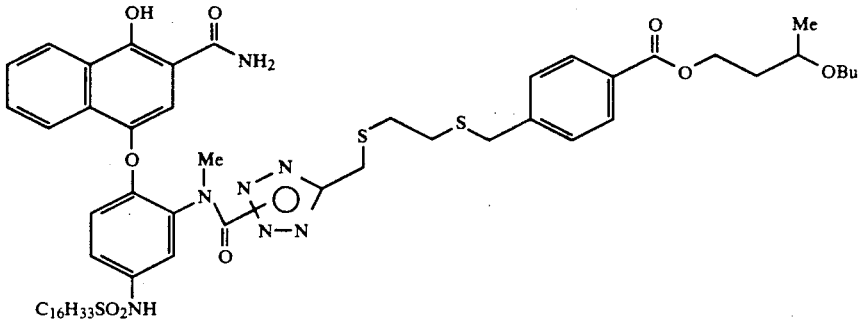

-continued

T37

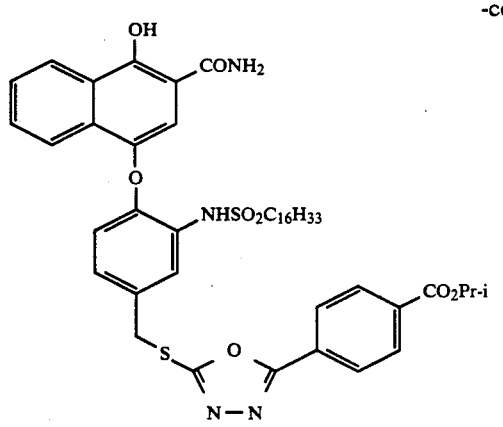

In order to incorporate the compounds according to the present invention and couplers to be used together into a silver halide emulsion layer known methods, including those described, e.g., in U.S. Pat. No. 2,322,027 can be used. For example, they can be dissolved in a solvent and then dispersed in a hydrophilic colloid. Examples of solvents usable for this process include organic solvents having a high boiling point, such as alkyl esters of phthalic acid (e.g., dibutyl phthalate, dioctyl phthalate, etc.), phosphoric acid esters (e.g., diphenyl phosphate, triphenyl phosphate, tricresyl phosphate, dioctyl butyl phosphate, etc.) citric acid esters (e.g., tributyl acetyl citrate, etc.) benzoic acid esters (e.g., octyl benzoate, etc.), alkylamides (e.g., diethyl laurylamides, etc.), esters of fatty acids (e.g. dibutoxyethyl succinate, dioctyl azelate, etc.), trimesic acid esters (e.g., tributyl trimesate, etc.), or the like; and organic solvents having a boiling point of from about 30° to about 150° C., such as lower alkyl acetates (e.g., ethyl acetate, butyl acetate, etc.), ethyl propionate, secondary butyl alcohol, methyl isobutyl ketone, b-ethoxyethyl acetate, methyl cellosolve acetate, or the like. Mixtures of organic solvents having a high boiling point and organic solvents having a low boiling point can also be used.

It is also possible to utilize the dispersing method using polymers, as described in Japanese Patent Publication No. 39853/76 and Japanese Patent Application (OPI) No. 59943/76.

Of the couplers, those having an acid group, such as a carboxylic acid group or a sulfonic acid group, can be introduced into hydrophilic colloids as an aqueous alkaline solution.

As the binder or the protective colloid for the photographic emulsion layers or intermediate layers of the photographic light-sensitive material of the present invention, gelatin is advantageously used, but other hydrophilic colloids can be used alone or together with gelatin.

As gelatin in the present invention, not only lime-processed gelatin, but also acid-processed gelatin may be employed. The methods for preparation of gelatin are described in greater detail in Ather Veis, *The Macromolecular Chemistry of Gelatin,* Academic Press (1964).

As the above-described hydrophilic colloids other than gelatin, it is possible to use proteins such as gelatin derivatives, graft polymers of gelatin and other polymers, albumin, casein, etc.; saccharides such as cellulose derivatives such as hydroxyethyl cellulose, cellulose sulfate, etc., sodium alginate, starch derivatives, etc.; and various synthetic hydrophilic high molecular weight substances such as homopolymers or copolymers, for example, polyvinyl alcohol, polyvinyl alcohol semiacetal, poly-N-vinylpyrrolidone, polyacrylic acid, polymethacrylic acid, polyacrylamide, polyvinyl imidazole, polyvinylpyrazole, etc.

In the photographic emulsion layer of the photographic light-sensitive material used in the present invention, any of silver bromide, silver iodobromide, silver iodochlorobromide, silver chlorobromide and silver chloride may be used as the silver halide. A preferred silver halide is silver iodobromide containing 15 mol % or less of silver iodide. A silver iodobromide emulsion containing from 2 mol % to 12 mol % of silver iodide is particularly preferred.

Although the mean grain size of silver halide particles in the photographic emulsion (the mean grain size being determined with a grain diameter in those particles which are spherical or nearly spherical, and an edge length in those particles which are cubic as a grain size, and is expressed as a mean value calculated from projected areas) is not particularly limited, it is preferably 6 μm or less.

The distribution of grain size may be broad or narrow.

Silver halide particles in the photographic emulsion may have a regular crystal structure, e.g., a cubic or octahedral structure, an irregular crystal structure, e.g., a spherical or plate-like structure, or a composite structure thereof. In addition, silver halide particles composed of those having different crystal structures may be used.

Further, the photographic emulsion wherein at least 50 percent of the total projected area of silver halide particles in tabular silver halide particles having a diameter at least five times their thickness may be employed.

The inner portion and the surface layer of silver halide particles may be different in phase. Silver halide particles may be those in which a latent image is formed mainly on the surface thereof, or those in which a latent image is formed mainly in the interior thereof.

The photographic emulsion used in the present invention can be prepared in any suitable manner, e.g., by the methods as described in P. Glafkides, *Chimie et Physique Photographique,* Paul Montel (1967), G. F. Duffin, *Photographic Emulsion Chemistry,* The Focal Press (1966), and V. L. Zelikman et al., *Making and Coating Photographic Emulsion,* The Focal Press (1964). That is, any of an acid process, a neutral process, an ammonia process, etc., can be employed.

Soluble silver salts and soluble halogen salts can be reacted by techniques such as a single jet process, a double-jet process, and a combination thereof. In addition, there can be employed a method (so-called reversal mixing process) in which silver halide particles are formed in the presence of an excess of silver ions.

As one system of the double jet process, a so-called controlled double jet process in which the pAg in a liquid phase where silver halide is formed is maintained at a predetermined level can be employed. This process can produce a silver halide emulsion in which the crystal form is regular and the grain size is nearly uniform.

Two or more kinds of silver halide emulsions which are prepared separately may be used as a mixture.

The formation or physical ripening of silver halide particles may be carried out in the presence of cadmium salts, zinc salts, lead salts, thallium salts, iridium salts or its complex salts, the rhodium salts or its complex salts, iron salts or its complex salts, and the like.

For removal of soluble salts from the emulsion after precipitate formation or physical ripening, a well known noodle washing process in which gelatin is gelated may be used. In addition, a flocculation process utilizing inorganic salts having a polyvalent anion (e.g., sodium sulfate), anionic surface active agents, anionic polymers (e.g., polystyrenesulfonic acid), or gelatin derivatives (e.g., aliphatic acylated gelatin, aromatic acrylated gelatin and aromatic carbamoylated gelatin) may be used.

Silver halide emulsions are usually chemically sensitized. For this chemical sensitization, for example, the methods as described in H. Frieser ed., *Die Grundlagen Der Photographischen Prozesse mit Silberhalogeniden,* Akademische Verlagsgesellschaft, pages 675 to 734 (1968) can be used. Namely, a sulfur sensitization process using active gelatin or compounds (e.g., thiosulfates, thioureas, mercapto compounds and rhodanines) containing sulfur capable of reacting with silver; a reduction sensitization process using reducing substances (e.g., stannous salts, amines, hydrazine derivatives, formamidinesulfinic acid and silane compounds); a noble metal sensitization process using noble metal compounds (e.g., complex salts of Group VIII metals in the Periodic Table, such as Pt, Ir and Pd, etc., as well as gold complex salts); and so forth can be applied alone or in combination with each other.

The photographic emulsion used in the present invention may include various compounds for the purpose of preventing fog formation or of stabilizing photographic performance in the photographic light sensitive material during the production, storage or photographic processing thereof. For example, those compounds known as antifoggants or stabilizers can be incorporated, including azoles such as benzothiazolium salts; nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (particular 1-phenyl-5-mercaptotetrazole), etc.; mercaptopyrimidines; mercaptotriazines; thioketo compounds such as oxazolinethione, etc.; azaindenes such as triazaindenes, tetraazaindenes (particularly 4-hydroxysubstituted (1,3,3a,7)tetraazaindenes), pentaazaindenes, etc.; benzenethiosulfonic acids; benzenesulfinic acids; benzenesulfonic amides, etc.

In the photographic emulsion layers or other hydrophilic colloid layers of the photographic lightsensitive material of the present invention can be incorporated various surface active agents as coating aids or for other various purposes, e.g., prevention of charging, improvement of slipping properties, acceleration of emulsification and dispersion, prevention of adhesion and improvement of photographic characteristics (for example, development acceleration, high contrast, and sensitization), etc.

Surface active agents which can be used are nonionic surface active agents, e.g., saponin (steroid-based), alkyene oxide derivatives (e.g., polyethylene glycol, a polyethylene glycol/polypropylene glycol condensate, polyethylene glycol alkyl ethers or polyethylene glycol alkylaryl ethers, polyethylene glycol esters, polyethylene glycol sorbitan esters, polyalkylene glycol alkylamines or polyalkylene glycol alkylamides, and silicone/polyethylene oxide adducts, etc.), glycidol derivatives (e.g., alkenylsuccinic acid polyglyceride and alkylphenol polyglyceride, etc.), fatty acid esters of polyhydric alcohols and alkyl esters of sugar, etc.; anionic surface active agents containing an acidic group, such as a carboxy group, a sulfo group, a phospho group, a sulfuric acid esters group, and a phosphoric acid ester group, for example, alkylcarboxylic acid salts, alkylsulfonic acid salts, alkylbenzenesulfonic acid salts, alkylnaphthalenesulfonic acid salts, alkylsulfuric acid esters, alkylphosphoric acid esters, N-acyl-N-alkyltaurines, sulfosuccinic acid esters, sulfoalkylpolyoxyethylene alkylphenyl ethers, and polyoxyethylene alkylphosphoric acid esters, amphoteric surface active agents, such as amino acids, aminoalkylsulfonic acids, aminoalkylsulfuric acid or aminoalkylphosphoric acid esters, alkylbetaines, and amine oxides; and cationic surface active agents, e.g., alkylamine salts, aliphatic or aromatic quaternary ammonium salts, heterocyclic quaternary ammonium salts (e.g., pyridinium and imidazolium) and aliphatic or hetercyclic phosphonium or sulfonium salts.

The photographic emulsion layer of the photographic light-sensitive material of the present invention may contain compounds such as polyalkylene oxide or its ether, ester, amine or like derivatives, thioether compounds, thiomorpholines, quaternary ammonium salt compounds, urethane derivatives, urea derivatives, imidazole derivatives, and 3-pyrazolidones for the purpose of increasing sensitivity or contrast, or of accelerating development.

In the photographic emulsion layer or other hydrophilic colloid layers of the photographic lightsensitive material of the present invention can be incorporated water-insoluble or sparingly soluble synthetic polymer dispersions for the purpose of improving dimensional stability, etc. Synthetic polymers which can be used include homo- or copolymers of alkyl acrylate or methacrylate, alkoxyalkyl acrylate or methacrylate, glycidyl acrylate or methacrylate, acrylamide or methacrylamide, vinyl esters (e.g., vinyl acetate), acrylonitrile, olefins, styrene, etc. and copolymers of the foregoing monomers and acrylic acid, methacrylic acid, $\alpha,\beta$-unsaturated dicarboxylic acid, hydroxyalkyl acrylate or methacrylate, sulfoalkyl acrylate or methacrylate, and styrenesulfonic acid, etc.

In photographic processing of layers composed of photographic emulsions in the photographic light sensitive material of the present invention, any of known procedures and known processing solutions, e.g., those described in *Research Disclosure,* No. 176, pages 28 to 30 can be used. The processing temperature is usually chosen from between 18° C. and 50° C., although it may be lower than 18° C. or higher than 50° C.

Any fixing solutions which have compositions generally used can be used in the present invention. As fixing agents, thiosulfuric acid salts and thiocyanic acid salts, and in addition, organic sulfur compounds which are known to be effective as fixing agents can be used. These fixing solutions may contain water-soluble aluminum salts as hardeners.

Color developing solutions are usually alkaline aqueous solutions containing color developing agents. As these color developing agents, known primary aromatic amine developing agents, e.g., phenylenediamines such as 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-β-methanesulfonamidoethylaniline, 4-amino-3-methyl-N-ethyl-N-β-methoxyethylaniline, etc., can be used to make exhaustive color reversal developers.

In addition, the compounds as described in L. F. A. Mason, *Photographic Processing Chemistry,* Focal Press, pages 226 to 229 (1966), U.S. Pat. Nos. 2,193,015 and 2,592,364, Japanese Patent Application (OPI) No. 64933/73, etc., may be used.

The color developing solutions can further contain pH buffering agents such as sulfite, carbonates, borates and phosphates of alkali metals, etc. developing inhibitors or anti-fogging agents such as bromides, iodides or organic anti-fogging agents, etc. In addition, if desired, the color developing solution can also contain water softeners; preservatives such as hydroxylamine, etc.; organic solvents such as benzyl alcohol, diethylene glycol, etc.; developing accelerators such as polyethylene glycol, quaternary ammonium slats, amines, etc; dye forming couplers; competing couplers; fogging agents such a sodium borohydride, etc.; auxiliary developing agents; viscosity-imparting agents; acid type chelating agents; anti-oxidizing agents; and the like.

After color developing, the photographic emulsion layer is usually bleached. This bleach processing may be performed simultaneously with a fix processing, or they may be performed independently.

Bleaching agents which can be used include compounds of metals, e.g., iron (III), cobalt (III), chromium (VI), and copper (II) compounds. For example, organic complex salts of iron (III) or cobalt (III), e.g., complex salts of acids (e.g., nitrilotriacetic acid, 1,3-diamino-2-propanoltetraacetic acid, etc.) or organic acids (e.g., citric acid, tartaric acid, malic acid, etc.); persulfates; permanganates; nitrosophenol, etc. can be used. Of these compounds, potassium ferricyanide, iron (III) sodium ethylenediaminetetraacetate, and iron (III) ammonium ethylenediaminetetraacetate are particularly useful. Ethylenediaminetetraacetic acid iron (III) complex salts are useful in both an independent bleaching solution and a mono-bath bleachfixing solution.

The photographic emulsion used in the present invention can also be spectrally sensitized with methine dyes or other dyes. Suitable dyes which can be employed include cyanine dyes, merocyanine dyes, complex cyanine dyes, complex merocyanine dyes, homopolar cyanine dyes, hemicyanine dyes, styryl dyes, and hemioxonol dyes. Of these dyes, cyanine dyes, merocyanine dyes and complex merocyanine dyes are particularly useful.

Any conventionally utilized nuclei for cyanine dyes are applicable to these dyes as basic heterocyclic nuclei. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc., and further, nuclei formed by condensing alicyclic hydrocarbon rings with these nuclei and nuclei formed by condensing aromatic hydrocarbon rings with these nuclei, that is, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc., are appropriate. The carbon atoms of these nuclei can also be substituted.

The merocyanine dyes and the complex merocyanine dyes that can be employed contain 5- or 6-membered heterocyclic nuclei such as pyrazolin-5-one nucleus, a thiohydantoin nucleus, a 2-thioxazolidin-2,4-dione nucleus, a thiazolidine-2,4-dione nucleus, a rhodanine nucleus, a thiobarbituric acid nucleus, and the like.

These sensitizing dyes can be employed individually, and can also be employed in combination. A combination of sensitizing dyes is often used particularly for the purpose of supersensitization.

The sensitizing dyes may be present in the emulsion together with dyes which themselves do not give rise to spectrally sensitizing effects but exhibit a supersensitizing effect or materials which do not substantially absorb visible light but exhibit a supersensitizing effect. For example, aminostilbene compounds substituted with a nitrogen-containing heterocyclic group (e.g., those described in U.S. Pat. Nos. 2,933,390 and 3,635,721), aromatic organic acid-formaldehyde condensates (e.g., those described in U.S. Pat. No, 3,743,510), cadmium salts, azaindene compounds, and the like, can be present.

The present invention is also applicable to a multilayer multicolor photographic material containing layers sensitive to at least two different spectral wavelength ranges on a support. A multilayer color photographic material generally possesses at least one red-sensitive silver halide emulsion layer, at least one green-sensitive silver halide emulsion layer and at least one blue-sensitive silver halide emulsion layer, respectively, on a support. The order of these layers can be varied, if desired. Ordinarily, a cyan forming coupler is present in a red-sensitive emulsion layer, a magenta forming coupler is present in a green-sensitive emulsion layer and yellow forming coupler is present in a blue-sensitive emulsion layer, respectively. However, if desired, a different combination can be employed.

The color reversal films of this invention are typically multilayer materials such as described in U.S. Pat. No. 4,082,553, U.S. Pat. No. 4,729,943, and U.S. Pat. No. 4,912,024; paragraph bridging pages 37–38. The support and other elements are as known in the art, e.g. see U.S. Pat. No. 4,912,024, column 38, line 37, and references cited therein.

EXPERIMENTAL

Synthesis Examples

Synthesis A:

-continued
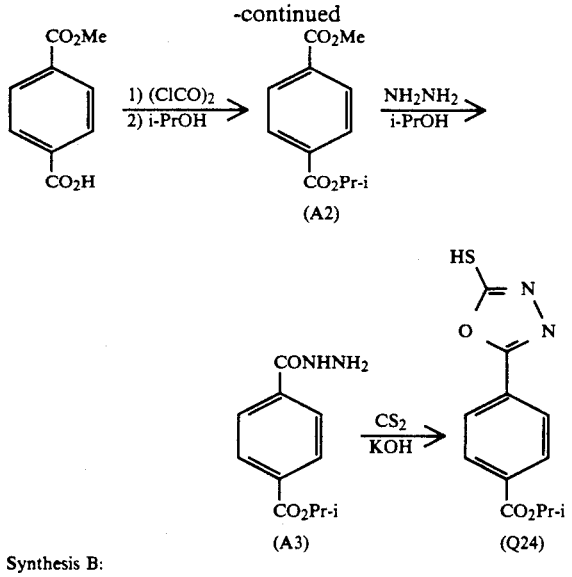
Synthesis B:
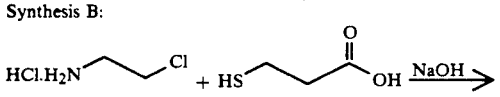
-continued
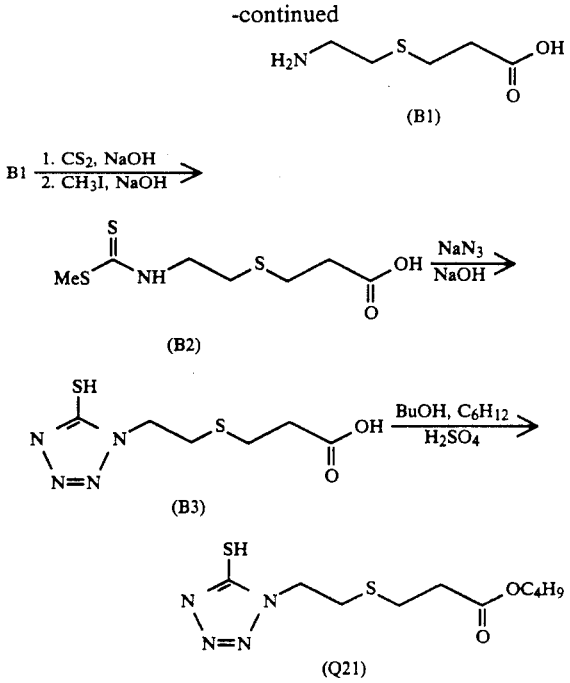
The synthesis of T1 is representative of reactions of inhibitors with compound B4:
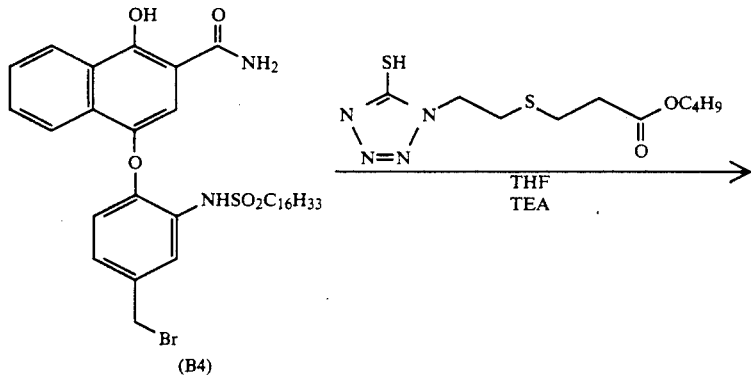
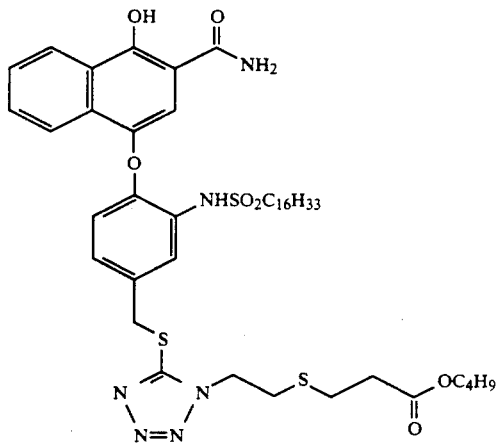
T1
Synthesis C:

-continued

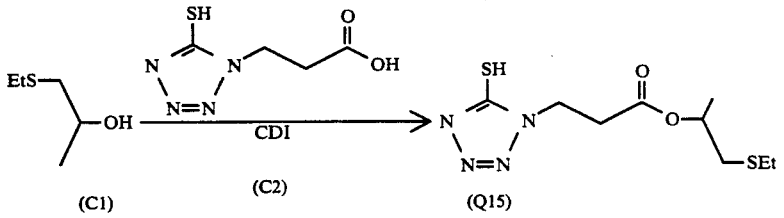

Synthesis Example A

Compound Q24

A suspension of mono-methyl terephthalate (13.1 g, 72.6 mmol) in dichloromethane (100 mL) was treated with oxalyl chloride (13.5 mL, 152 mmol), then a catalytic quantity of DMF (ca. 0.1 g). After stirring for 1.5 h, the volatiles were removed in vacuo to provide the acid chloride (A1) as an off-white solid. This was used in the subsequent reaction without further purification.

A solution of acid chloride A1 (72.6 mmol) in THF (150 mL) was reacted with isopropanol (6.1 mL, 79.4 mmol) in the presence of triethylamine (21 mL, 150 mmol) and a catalytic quantity of DMAP (ca. 0.1 g) at reflux overnight. After cooling, the solid triethylammonium chloride was removed via filtration. The filtrate was dissolved in ethyl acetate and washed successively with 2 N HCl, water, 5% $NaHCO_3$ and brine, dried ($MgSO_4$) and concentrated in vacuo to afford the diester (A2) as a light yellow oil (15.08 g, 94% yield).

Diester A2 (12.43 g, 56 mmol), isopropanol (5 mL) and hydrazine monohydrate (3.44 g, 69 mmol) were combined and sealed in a pressure tube under an atmosphere of nitrogen. The tube was heated at 100° C. overnight. Once cooled a solid formed which was diluted with alcohol and added to a rapidly stirring ice-water mixture. Hydrazide (A3), a white solid, was collected via filtration, washed with water and dried in vacuo (7.62 g, 61% yield).

A suspension of hydrazide A3 (6.2 g, 27.9 mmol) in isopropanol (80 mL) was treated with aqueous KOH (27.9 mmol in 5 mL of water) and carbon disulfide (4.5 mL, 75 mmol), stirred at ambient temperature for 20 min, after which the excess carbon disulfide was distilled off. The resultant mixture was stirred at ambient temperature overnight. The product, Q24, was isolated by pouring the mixture into a rapidly stirring ice-water-HCl mixture collecting the solid, washing with water and drying (6.72 g, 91% yield, mp 169.5°-170.5 ° C.).

Synthesis Example B

Compound B2

3-Mercaptopropionic acid (68.6 g, 0.647 mol) and 250 mL water were placed in a 1 L three-neck flask fitted with a reflux condenser with a nitrogen gas inlet/outlet, addition funnel, magnetic stirring bar, and thermometer. The solution was cooled to 0° C. Add a room temperature solution of NaOH (78.0 g, 1.44 mol, 3.1 eq.) in 100 mL water all at once. The temperature rose to 50° C. The solution was cooled to room temperature and a solution of 2-chloro-ethylamine monohydrochloride (75.0 g, 0.647 mol) in 100 mL water was added. over 10 min. The solution was warmed to 60° C. for 45 min. and then cooled to 15° C. To the vigorously stirred solution of (B1) was added solid NaOH (26.0 g, 0.647 mol) and carbon disulfide (98.4 g, 1.29 mol, 2 eq.). After stirring overnight, the mixture was warmed to 45° C. for 15 min.. The solution was cooled to 10° C., the bath removed, and methyl iodide (98.0 g, 0.676 mol) added. The temperature slowly rose to 20° C. After 1 hr. the solution was warmed to 45° C. for 15 min. The solution was cooled to 10° C., acidified with conc. HCl to pH 1, and the resulting light green oil extracted two times with 300 mL ethyl acetate. The combined extracts were washed twice with 50 mL 50% brine and 50 mL brine. The light yellow solution was extracted with 800 mL 10% $NaHCO_3$ and 200 mL 5% $NaHCO_3$. The combined extracts were acidified with conc HCl, and the resulting oil extracted into 500 mL and 250 mL ethyl acetate. The extracts were combined and washed with 100 mL brine. The solution was dried over $MgSO_4$, filtered, and evaporated to give 132 g (B2) as a light yellow oil. Yield: 85%.

Compound B3

The reaction was carried out in a 1 L flask fitted with a magnetic stirring bar and a reflux condenser fitted with a nitrogen inlet/outlet connected through a bubbler to the side arm of a very lightly stoppered 4 L Erlenmeyer flask. The Erlenmeyer flask was filled with 1 gal of bleach and the bleach stirred rapidly in an ice bath to act as a methyl mercaptan scrubber. To the flask was added (B2) (130 g, 0.543 mol) and 300 mL water. The mixture was cooled in an ice bath while 50% NaOH (43.4 g, 0.543 mol) was added in portions. The pH of the resulting light yellow solution was between 7 and 8. The stirred solution was gently heated to near boiling under nitrogen; a vigorous evolution of methyl mercaptan commenced and a small amount of oil formed. After gently refluxing for one hour the orange solution was cooled to 40° C. and 50 mL 5% $NaHCO_3$ added. The solution was extracted with 150 mL ethyl acetate. The aqueous layer was treated with 50 g NaCl and acidified with 100 mL conc. HCl; the resulting oil was extracted into 300 mL and 100 mL ethyl acetate. The ethyl acetate solution was washed with 50 mL brine and then extracted with 500 mL and 50 mL 10% $NaHCO_3$. The extracts were combined, acidified with conc. HCl, saturated with NaCl, and the resulting oil extracted into ethyl acetate. The light orange solution was extracted with 50 mL brine, dried over $MgSO_4$, treated with 5 g NORIT TM, filtered, and evaporated to a light yellow oil. The oil was triturated with 300 mL toluene to give (B3) as an off-white waxy solid. Yield: 97.0 g, 76%.

Compound Q21

A solution of (B3) (50.0 g, 0.213 mol), n-butyl alcohol (47 g, 0.639 mol, 3 eq.), and 0.75 mL conc. sulfuric acid in 75 mL cyclohexane was refluxed for one hour; the water formed was collected in a Dean-Stark trap filled with 4 Å molecular sieves. The solution was cooled and added to 300 mL ethyl acetate. The solution was extracted twice with 50 mL water, and then with 400 mL and 2×50 mL 5% $NaHCO_3$. The bicarbonate extracts were combined and acidified with conc. HCl. The resulting oil was extracted into 300 mL and 2×50 mL ethyl actetate. The solution was washed with 50 mL brine, dried over $MgSO_4$, filtered, and evaporated, finally at 80° C., to obtain Q21 as a pale yellow oil. Yield: 51 g, 83%.

Compound T1

The synthesis of compound B4 is described in U.S. Pat. No. 5,151,343. Compound B4 (23.7 g, 0.035 mol), Q21 (10.2 g, 0.035 mol), and triethyl amine (8.8 g, 0.087 mol, 2.5 eq.) were combined in 100 mL dry tetrahydrofuran. After 30 min. the mixture was poured into 500 mL ice-water containing 25 mL conc HCl. The product was extracted into ethyl acetate, and the solution washed with water, twice with 5% $NaHCO_3$, dilute HCl, water, and brine. The solution was dried over $MgSO_4$, filtered, and evaporated to give a glass. The glass was chromatographed through 1 L silica gel, eluting with a mixture of 7:1 dichloromethane:ethyl acetate to give 26.5 g pale yellow glass. The glass was crystallized from methanol to give T1, mp 95°-97° C. Yield: 23.1 g, 75%.

Synthesis Example C

Compound Q15

Compound C2, 1-(2-Carboxyethyl)-5-mercapto-1,2,3,4-tetrazole, was prepared using the general synthesis described in U.S. Pat. No. 4,782,012. Compound C2 (12.5 g, 71.8 mmol), compound Q15 (8.63 g, 71.8 mmol), 5mL N-methylpyrolidinone and 75 mL acetonitrile were placed in a 250 mL flask fitted with a magnetic stirrer and a reflux condenser under a nitrogen atmosphere. To the stirred slurry was added, over ca. 5 min, solid carbonyldiimidazole (11.5 g, 72.0 mmol). Vigorous gas evolution was observed followed by the appearance of a precipitant. After stirring ca. 5 min. more, 3-thioethyl-2-propanol (Cl) (8.63 g, 71.8 mmol) was added and the mixture heated at reflux for 35 min. The mixture was cooled, the acetonitrile evaporated off in vacuo and 3N HCl (110mL) was added to the residue. Extraction of the aqueous mixture was effected with ethyl acetate (2×100 mL). The combined organic layers were washed with water (2×100 mL), brine, (50 mL), dried ($MgSO_4$), filtered, and evaporated to give 18.8 g of (Q15) as a light orange red oil. Yield:.95%.

All compounds gave satisfactory 300 MHz proton NMR spectra and other analytical data consistent with the desired compounds.

Half-Life Determinations

Rates of hydrolysis of self-destruct inhibitors were measured by analyzing reaction solutions for the concentration of remaining starting material as a function of time. For convenience the half-lives of the self-destruct inhibitors of the invention were determined at pH 11.75 and extrapolated to pH 10.0. The reactions were initiated by mixing 0.25 mL of a 0.005M solution of self-destruct inhibitor (in DMF) with 25.0 mL of pH 11.75 phosphate buffer solution (0.010M total phosphate), giving an initial concentration of self-destruct inhibitor of $5.0\times10^{-5}$M, DMF concentration of 1%, and ionic strength of 0.04. The buffer solution was thermostatted at 38° C. before and after the addition of self-destruct inhibitor, and it was kept stoppered except to transfer solution via pipette. At various times, 1.0 mL of reaction solution was withdrawn, added to a 5 mL beaker and quenched with 0.25 mL of 30% acetic acid while rapidly stirring. The reaction time was taken as the time at which the acetic acid quench was added to the reaction solution. The concentration of self-destruct inhibitor was determined by HPLC: SUPELCO C-8 column using a mobile phase consisting of 28% acetonitrile and 2% acetic acid solution (0.016M) at a flow rate of 1.0 mL/min. Quantitation was based upon peak areas compared to solutions of self-destruct inhibitor of known concentration. The disappearance of self-destruct inhibitor followed first-order kinetics. A first order rate constant, $k_{obs}$, was obtained by fitting the concentration vs. time data to an exponential decay function. Assuming first-order kinetics with respect to hydroxide concentration, the half-life at pH 10.0 would be: $t_{\frac{1}{2}}(10.0)=10^{1.75}\times t_{\frac{1}{2}}(11.75)=56[0.693/k_{obs}(11.75)]$. The half-lives of the comparison inhibitors were measured as described above except at pH 10.0 (carbonate buffer). The data is presented in Table 1, below.

TABLE 1

Table of Half-Life Values

| Inhibitor | half-life (at pH 10.0) |
|---|---|
| Q15 (invention) | 19 h |
| Q20 (invention) | 54 h |
| Q21 (invention) | 21 h |
| Q23 (invention) | 37 h |
| Q24 (invention) | 50 h |
| CI1 (comparison) | 13 min |
| CI2 (comparison) | 2 min |

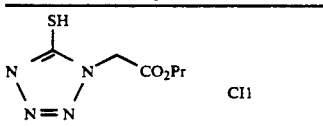

CI1

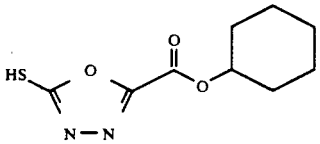

CI2

A method for the determination of "inhibitor strength" is described below:

First, a green sensitive silver bromoiodide gelatin emulsion containing 4.0 mol-percent iodide and having an approximate grain length/thickness ratio of 0.70/0.09 micrometers was mixed with a coupler dispersion comprising Cyan Coupler C-1 dispersed in half its weight of di-n-butylphthalate. The resulting mixture was coated onto a cellulose triacetate support according to the following format:

| | | |
|---|---|---|
| OVERCOAT LAYER: | gelatin bis(vinylsulfonylmethyl)ether hardener (1.9% of total gelatin weight) | 7.5 g/m² |
| EMULSION LAYER: | AgBrI emulsion | 1.08 g/m² (as silver) |
| | coupler | 2.07 mmoles/m² |
| | gelatin | 4.04 g/m² |
| FILM SUPPORT | | |

The resulting photographic element (hereafter referred to as the test coating) was cut into 12 inch×35 mm strips and was imagewise exposed to light through a graduated density test object in a commercial sensitometer (3000 K light source, 0-3 step wedge, with a Wratten 99 plus 0.3 ND filter) for 0.01 sec to provide a developable latent image. The exposed strip as then slit lengthwise into two 12 inch×16 mm strips. One strip so prepared was subjected to the photographic process sequence outlined below:

| | |
|---|---|
| First developer | 4 min. |
| Water wash | 2 min. |
| Reversal bath | 2 min. |
| Color developer | 4 min. |
| Conditioner | 2 min. |
| Bleach | 6 min. |
| Fix | 4 min. |
| Water wash | 2 min. |

All solutions of the above process were held at a temperature of 36.9° C. The compositions of the processing solution are as follows:

| | |
|---|---|
| First developer: | |
| Amino tris(methylenephosphonic acid), pentasodium salt | 0.56 g |
| Diethylenetriaminepentaacetic acid, pentasodium salt | 2.50 g |
| Potassium sulfite | 29.75 g |
| Sodium bromide | 2.34 g |
| Potassium hydroxide | 4.28 g |
| Potassium iodide | 4.50 mg |
| 4-Hydroxymethyl-4-methyl-1-phenyl-3-pyrazolidinone | 1.50 g |
| Potassium carbonate | 14.00 g |
| Sodium bicarbonate | 12.00 g |
| Potassium hydroquinone sulfonate | 23.40 g |
| Acetic acid (glacial) | 0.58 g |
| Water to make 1.0 liter | |
| Reversal bath: | |
| Propionic acid | 11.90 g |
| Stannous chloride (anhydrous) | 1.65 g |
| p-Aminophenol | 0.5 mg |
| Sodium hydroxide | 4.96 g |
| Amino tris(methylenephosphonic acid), | 8.44 g |
| Water to make 1.0 liter | |
| Color Developer: | |
| Amino tris(methylenephosphonic acid), pentasodium salt | 2.67 g |
| Phosphoric acid (75% solution) | 17.40 g |
| Sodium bromide | 0.65 g |
| Potassium iodide | 37.5 mg |
| Potassium hydroxide | 27.72 g |
| Sodium sulfite | 6.08 g |
| Sodium metabisulfite | 0.50 g |
| Citrazinic acid | 0.57 g |
| Methanesulfonamide, N-[2-[(4-amino-3-methylphenyl)ethylamino]ethyl]-sulfate (2:3) | 10.42 g |
| 3,6-dithia-1,8-octanediol | 0.87 g |
| Acetic acid (glacial) | 1.16 g |
| Water to make 1.0 liter | |
| Conditioner: | |
| (Ethylenedinitrillo)tetraacetic acid | 8.00 g |
| Potassium sulfite | 13.10 g |
| Thioglycerol | 0.52 g |
| Water to make 1.0 liter | |
| Bleach: | |
| Potassium nitrate | 25.00 g |
| Ammonium bromide | 64.20 g |
| Ammonium ferric (ethylenediamine) | 124.9 g |
| Hydrobromic acid | 24.58 g |
| (Ethylenedinitrilo)tetraacetic acid | 4.00 g |
| Potassium hydroxide | 1.74 g |
| Water to make 1.0 liter | |
| Fixer: | |
| Ammonium thiosulfate | 95.49 g |
| Ammonium sulfite | 6.76 g |
| (Ethylenedinitrilo)tetraacetic acid | 0.59 g |
| Sodium metabisulfite | 7.12 g |
| Sodium hydroxide | 1.00 g |
| Water to make 1.0 liter | |

After the test coating was subjected to this processing sequence and dried the maximum density was read to status A densitometry using a commercial densitometer. This density is called $D_{max}$ (solution A).

The other half of the exposed test coating was processed through the same sequence except that the color developer contained 0.25 mmol of the INH compound in addition to the components listed in the above formula. The inhibitor was dissolved in 1 mL of DMF, added to the color developer and vigorously stirred for 30 s before immersion of the film strips for development. The maximum density obtained for test coating processed in this manner is called $D_{max}$ (solution B). The inhibitor number, IN, of the INH compound is defined as:

$$IN = \frac{D_{max}(\text{solution } A) - D_{max}(\text{solution } B)}{D_{max}(\text{solution } A)} \times 100$$

The inhibitor strength, IS, of the INH compound is defined as:

$$IS = \frac{IN_{(test)}}{IN_{(control)}}$$

where $IN_{(test)}$ is the inhibitor number determined by the method described above for any INH compound of interest, and $IN_{(control)}$ is the inhibitor number determined for the test coating when 1-phenyl-5-mercapto-1,2,3,4-tetrazole is the INH compound incorporated into the color developer.

The following examples further illustrate this invention:

EXAMPLE 1

This example demonstrates that the inhibitors of the invention exert inhibition of development at processing times, but decompose to inactive species upon standing in the high pH developer and, thus, are essentially non-seasoning. The comparison examples represent typical hydrolyzable inhibitors in the art and are totally deactivated and ineffective as inhibitors in high pH processes at processing times.

For this evaluation, single layer film strips were coated and processed as described above for the "inhibitor strength" test. Additionally after standing for one hour, a second film strip was processed through the inhibitor spiked developer. This process was repeated after two hours where appropriate. The inhibitor numbers so determined are given in Table 2 below.

TABLE 2

| | Inhibitor Numbers | | |
|---|---|---|---|
| | IN (Inhibitor Number) at TIME* of | | |
| SAMPLE | 30 s | 1 h | 2 h |
| Q14 (inv.) | 72 | 0 | — |
| Q15 (inv.) | 32 | 0 | — |
| Q21 (inv.) | 37 | 0 | — |
| Q23 (inv.) | 73 | 4 | 0 |
| Q24 (inv.) | 34 | 0 | — |
| CI1 (comp.) | 0 | — | — |

TABLE 2-continued

| SAMPLE | Inhibitor Numbers IN (Inhibitor Number) at TIME* of 30 s | 1 h | 2 h |
|---|---|---|---|
| CI2 (comp.) | 0 | — | — |

*TIME refers to the time after sample spiking of the color developer that single layer film strips were immersed in the color developer.

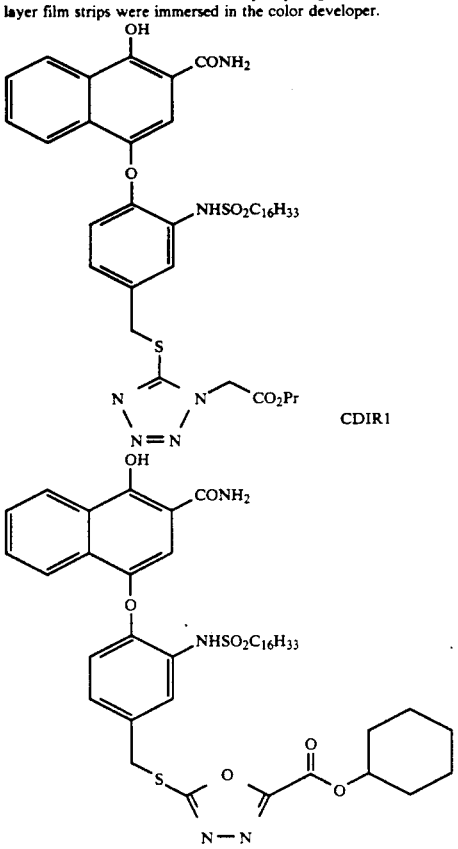

CDIR1

CDIR2

EXAMPLE 2

1.0 g of T20 was dissolved in 2.0 g of N,N-Diethyl lauramide and 3.0 g of ethyl acetate with gentle heating. This solution was then brought to a temperature of 40° C. and then mixed with a solution containing 3.0 g pig gelatin and 0.3 g of the sodium salt of triisopropylnathphalene sulfonic acid dissolved in 40.7g. of distilled water. The resulting mixture was then passed through a colloid mill three times to produce a dispersion. This dispersion was then used to prepare a photographic element designated as Sample 101 having the composition set forth below:

In the composition of the layers, the coating amounts are shown as g/m$^2$, except for sensitizing dyes, which are shown as the molar amount per mole of silver halide present in the same layer.

Photographic support: cellulose triacetate subbed with gelatin.

| | |
|---|---|
| First layer: Red sensitive layer | |
| Silver iodobromide emulsion (as silver) (4 mol % iodide) | 1.18 |
| Red sensitizing dyes | $1.42 \times 10^{-3}$ |
| Cyan Coupler C-1 | 1.71 |
| Di-n-butylphthalate | 0.85 |
| T20 | 0.04 |
| Gelatin | 4.03 |
| Second layer: Intermediate layer | |
| Competitor S-3 | 0.16 |
| Dye-1 | 0.06 |
| Gelatin | 0.86 |
| Third layer: Green sensitive layer | |
| Silver iodobromide emulsion (as silver) (4 mol % iodide) | 1.18 |
| Green sensitizing dyes | $2.0 \times 10^{-3}$ |
| Coupler M-1 | 1.67 |
| Tritolylphosphate | 0.84 |
| Gelatin | 4.03 |
| Fourth layer: Protective layer | |
| Gelatin | 3.23 |

-continued

| | |
|---|---|
| Bis(vinylsulfonylmethane) | 0.23 |

C-1

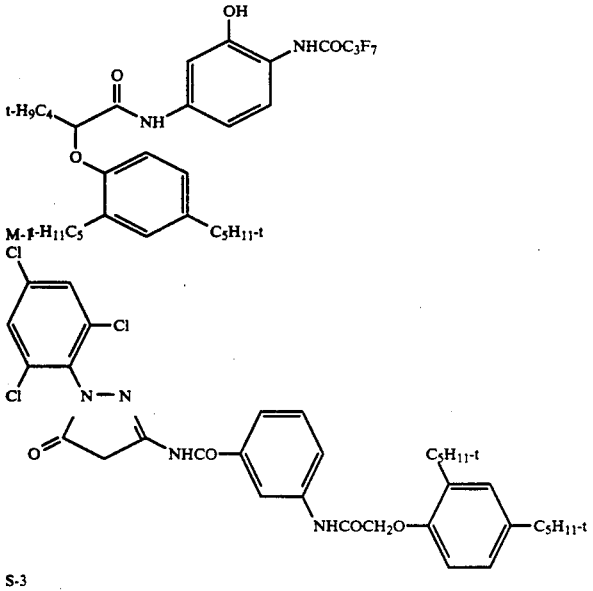

S-3

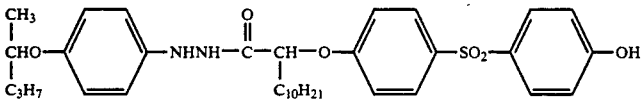

DYE-1

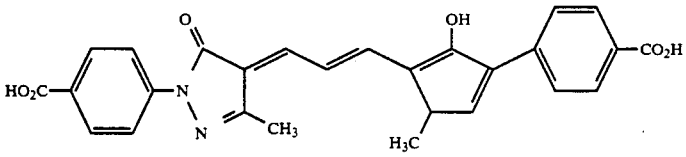

SENSITIZING DYE-1

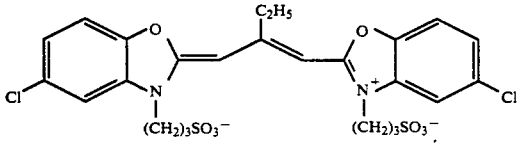

SENSITIZING DYE-2

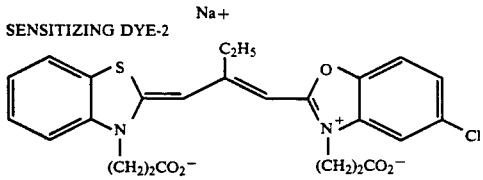

Magenta Absorber Dye

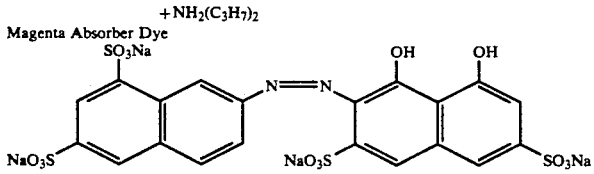

In a similar fashion samples 102 to 107 were prepared except that T20 was replaced with equimolar amounts of the DIR as indicated in Table 3. After drying, the samples were slit into 12 inch×35 mm strips and exposed as follows:

First, the red-sensitive layer was exposed in an imagewise fashion to a 0–3 density step tablet plus a Wratten 29 filter using a commercial sensitometer (3000 k lamp temperature) for 0.01 sec. The green-sensitive layer was then given a uniform flash exposure using the same sensitometer with a Wratten 99 filter, but without the step tablet. The intensity of the green exposure was selected to be that which gave a Status A green analytical maximum density of approximately 2.0, after photographic processing, for sample 100, which was identical in composition to sample 101 except that it contained no DIR. The exposed samples were processed according to the sequence described above. All solutions of the above process were held at a temperature of 36.9° C. The compositions of the processing solution are the same as described above.

After processing, the densities of the samples were read to status A densitometry using a commercial densitometer. The densities were converted to analytical densities in the usual manner so that the red and green densities reflected the amount of cyan and magenta dyes formed in the respective layers. The results are tabulated in Table 3. It can be seen that the DIR compounds of this invention that release INH—L—Y moieties having inhibitor half-lives greater than 4 h at pH 10.0 produce greater reductions in the red maximum density than do the comparison DIR compounds that release INH—L—Y moieties having inhibitor half-lives less than 4 h at pH 10.0. The ability to reduce the density in the layer in which the DIR compound is coated is an indication of DIR compound's ability to produce sharpness improvements. Also recorded in Table 3 is a parameter called Delta $D_{max}$ ($\Delta D_{max}$), which is the difference in the green density measured in an area of the film strip where the red density is a minimum, minus the green density measured in an area where the red density is a maximum. As such, this parameter reflects the ability of a DIR compound coated in one layer to alter the dye formation in another layer. The data in Table 3 shows that some DIR compounds of this invention, samples 101 and 102, have a substantially greater effect on the dye density formed in the green sensitive layer than do comparison DIR compounds. This very desirable property enables the preparation of film elements that have enriched color saturation.

TABLE 3

| SAMPLE | DIR | INH in DIR | RED $D_{max}$ | $\Delta D_{max}$ (GREEN) |
|---|---|---|---|---|
| 100 (check) | NONE | — | 3.20 | 0.18 |
| 101 (inv.) | T20 | Q14 | 2.37 | 0.41 |
| 102 (inv.) | T25 | Q15 | 2.27 | 0.56 |
| 103 (inv.) | T1 | Q21 | 1.15 | 0.27 |
| 104 (inv.) | T2 | Q23 | 1.82 | 0.28 |
| 105 (inv.) | T37 | Q24 | 2.56 | 0.24 |
| 106 (comp.) | CDIR1 | CI1 | 3.14 | 0.29 |
| 107 (comp.) | CDIR2 | CI2 | 3.14 | 0.25 |

By weak or substantially no inhibitor properties is meant that the inhibitor after decomposition does not substantially season the developer.

The invention has been described in detail with particular reference to preferred embodiments thereof, but it will be understood that variations and modifications can be effected within the spirit and scope of the invention.

What is claimed is:

1. A silver halide photographic light-sensitive material for development in a development solution at a pH of at least 11.4, the material comprising a support having a silver halide emulsion layer comprising a compound capable of releasing a development inhibitor having a decomposition half-life in the range of above 4 to 225 hours at pH 10, said inhibitor after decomposition having substantially no photographic inhibitor properties, the compound having the formula:

$$CAR—(TIME)_n—INH—L—Y \quad (I)$$

wherein:

CAR is a carrier moiety releasing —(TIME)$_n$—INH—L—Y by reaction with oxidized developer;

TIME is a timing group;

INH—L—Y is a development inhibitor moiety selected from the group consisting of oxazole, thiazole, diazole, oxathiazole, triazole, thiatriazole, tetrazole, benzimidazole, indazole, isoindazole, mercaptothiazole, mercaptotriazole, mercaptothiadiazole, mercaptotetrazole, selenotetrazole, mercaptooxadiazole, selenobenzothiazole, mercaptobenzoxazole, selenobenzoxazole, mercaptobenzimidazole, selenobenzimidazole, benzodiazole, or benzisodiazole such that an inhibitor moiety comprising H—INH—L—Y has a calculated log P of greater than 0.4 and n is 0, 1 and 2;

L is a divalent connecting group containing a chemical bond which is broken in a photographic developing solution and is selected from: —$CO_2$—, —N-$R_eCO_2$—, —$SO_2O$—, —$OCH_2CH_2SO_2$—, —OC(=O)O—, or —$NR_eC(=O)C(=O)$—, where $R_e$ is H, an alkyl group, an alkenyl group, an aryl group, or a heterocyclic group; and Y represents an alkyl group, an alkenyl group, an aryl group, or a heterocyclic group.

2. A silver halide photographic light-sensitive material as in claim 1, wherein the material comprises a color reversal film element.

3. The photographic element in accordance with claim 1 wherein INH—L—Y is selected from:

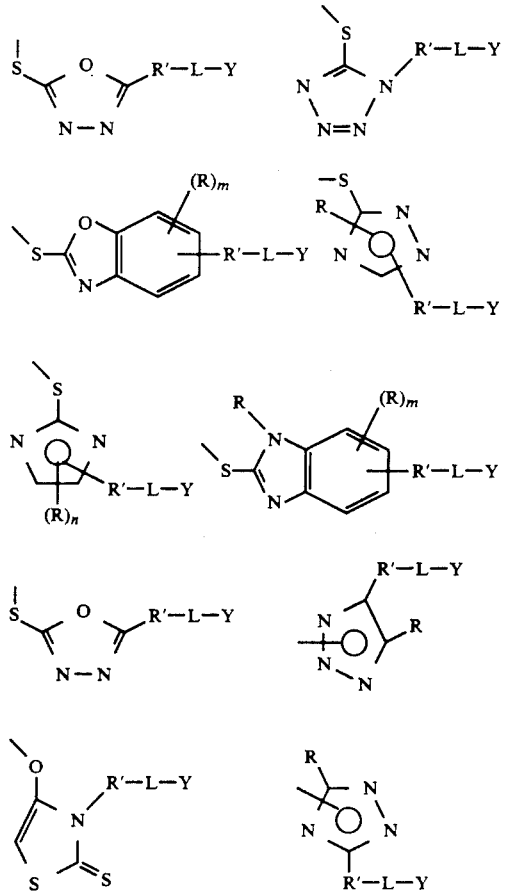

-continued

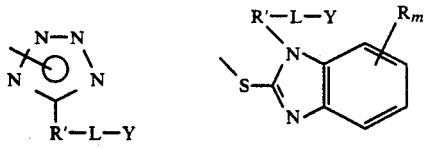

wherein R' is selected from an alkyl group, an aryl group, or a 5- or 6-membered heterocyclic ring, alkoxy group, aryloxy group, alkoxycarbonyl group, arlyoxycarbonyl group, amino group, sulfamoyl group, sulfonamido group, sulfoxyl group, carbamoyl group, alkylsulfo group, arylsulfo group, aryloxycarbonylamino group, alkoxycarbonylamino group, acylamino group, ureido group, arylthio group, alkylthio group; R is selected from those listed for R' above, or is selected from hydrogen, fluorine, chlorine, bromine, and iodine, hydroxy group, or cyano group; when there are two or more R groups on a molecule, R may be the same or different; n is 0 to 2 and m is 0 to 3.

4. The photographic element in accordance with claim 1 wherein INH—L—Y is selected from:

Q12

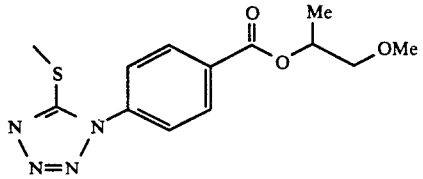

Q14

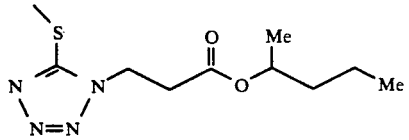

Q15

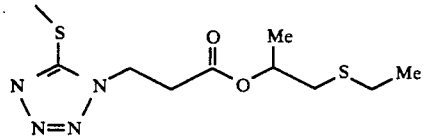

Q16

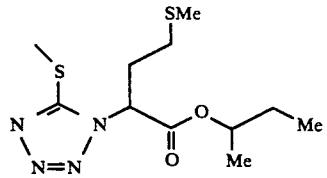

Q17

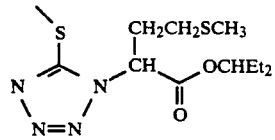

Q18

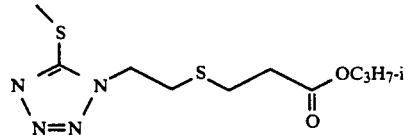

-continued

Q19

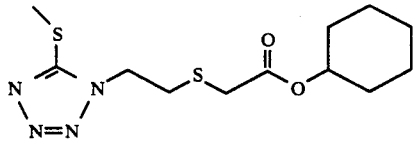

Q20

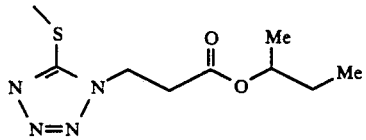

Q21

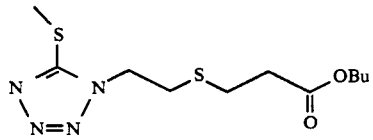

Q22

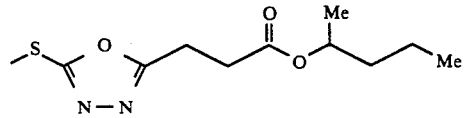

Q23

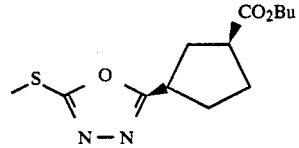

Q24

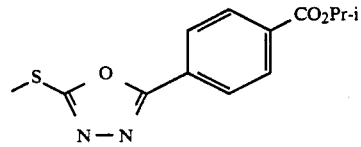

Q25

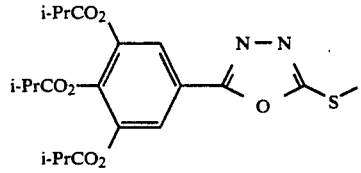

Q26

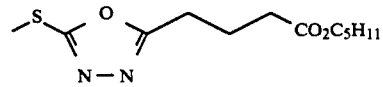

5. The photographic element in accordance with claim 1 wherein the compound (I) is selected from the following structures:

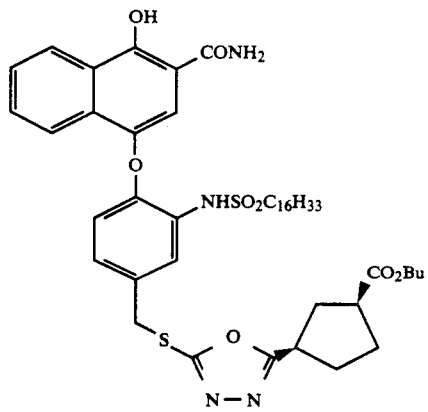

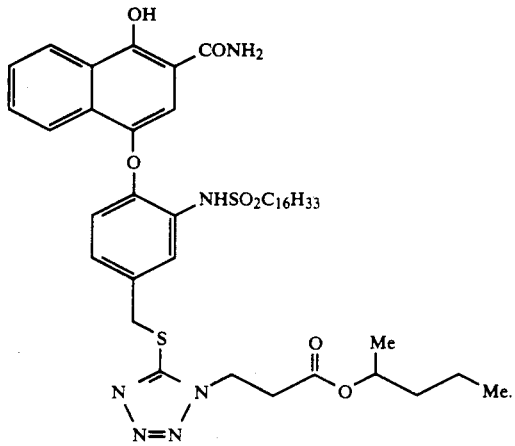

6. A silver halide color photographic light-sensitive material as in claim 1, wherein the development inhibitor has an inhibitor strength of greater than 0.5.

7. The photographic element in accordance with claim 1 wherein CAR is a coupler moiety.

8. The photographic element in accordance with claim 7 wherein the coupler moiety is ballasted.

9. The photographic element in accordance with claim 1 wherein CAR is unballasted and at least one of the —(TIME)$_n$— moieties is ballasted.

10. The photographic element in accordance with claim 9 wherein CAR is a coupler moiety.

11. The photographic element in accordance with claim 1 wherein CAR is a moiety which can cross-oxidize from oxidized color developer, and is selected from hydroquinones, catechols, aminophenols, aminonaphthols, sulfonamidophenols, sulfoamidonapthols, and hydrazides.

12. The photographic element in accordance with claim 1 wherein the compound is preset in the element from about 0.5 to about 30 mg/ft$^2$.

13. The photographic element in accordance with claim 1 wherein the compound is present in the element from about 1 to about 10 mg/ft$^2$.

14. A color reversal silver halide photographic light-sensitive material suitable for development in a color reversal process, wherein said process includes a color developer solution at a pH of at least 11.4, the material comprising a support having a silver halide emulsion layer comprising a compound capable of releasing a development inhibitor having a decomposition half-life in the range of above 4 to 225 hours at pH 10, said inhibitor after decomposition having substantially no photographic inhibitor properties, the compound having formula:

$$\text{CAR—(TIME)}_n\text{—INH—L—Y} \qquad \text{(I)}$$

wherein:

CAR is a carrier moiety released from —(TIME)$_n$—INH—L—Y by reaction with oxidized developer;

TIME is a timing group;

INH—L—Y is a development inhibitor moiety selected from the group consisting of oxazole, thiazole, diazole, oxathiazole, triazole, thiatriazole, tetrazole, benzimidazole, indazole, isoindazole, mercaptothiazole, mercaptotriazole, mercaptothiadiazole, mercaptotetrazole, selenotetrazole, mercaptooxadiazole, selenobenzothiazole, mercaptobenzoxazole, selenobenzoxazole, mercaptobenzimidazole, selenobenzimidazole, benzodiazole, or benzisodiazole such that an neutral inhibitor moiety comprising H—INH—L—Y has a calculated log P of greater than 0.4 and n is 0, 1 or 2;

L is a divalent connecting group containing a chemical bond which is broken in a photographic developing solution and is selected from —$CO_2$—, —N-$R_eCO_2$—, —$SO_2O$—, —$OCH_2CH_2SO_2$—, —OC(=O)O—, or —$NR_eC$(=O)C(=O)—, where $R_e$ is H, an alkyl group, an alkenyl group, an aryl group, or a heterocyclic group; and Y represents an alkyl group, an alkenyl group, an aryl group, or a heterocyclic group.

15. A silver halide color photographic light-sensitive material as in claim 14, wherein the development inhibitor has an inhibitor strength of greater than 0.5.

16. The photographic element in accordance with claim 14 wherein CAR is a coupler moiety.

17. The photographic element in accordance with claim 16 wherein the coupler moiety is ballasted.

18. The photographic element in accordance with claim 14 wherein CAR is unballasted and at least one of the —(TIME)$_n$— moieties is ballasted.

19. The photographic element in accordance with claim 14 wherein CAR is a moiety which can cross-oxidize with oxidized color developer, and is selected from hydroquinones, catechols, aminophenols, aminonaphthols, sulfonamidophenols, sulfonamidonaphthols, and hydrazides.

20. The photographic element in accordance with claim 14 wherein the compound is present in the element from about 0.5 to about 30 mg/ft$^2$.

21. The photographic element in accordance with claim 14 wherein the compound is present in the element from about 1 to about 10 mg/ft$^2$.

22. The photographic element in accordance with claim 1 wherein the development inhibitor has a decomposition half-life in the range of 6 to 120 hours at pH 10.

23. The photographic element in accordance with claim 14 wherein the development inhibitor has a decomposition half-life in the range of 6 to 120 hours at pH 10.

24. The silver halide photographic light-sensitive material for development in a development solution at a pH of at least 11.4, the material comprising a support having a silver halide emulsion layer comprising a compound capable of releasing a development inhibitor having a decomposition half-life in the range of above 4 to 225 hours at pH 10, said inhibitor after decomposition having substantially no photographic inhibitor properties, the compound having the formula:

$$CAR—(TIME)_n—INH—L—Y \quad (I)$$

wherein:

CAR is a carrier moiety releasing —(TIME)$_n$—INH—L—Y by reaction with oxidized developer;

TIME is a timing group;

INH—L—Y is a development inhibitor moiety selected from the group consisting of oxazole, thiazole, diazole, oxathiazole, triazole, thiatriazole, tetrazole, benzimidazole, indazole, isoindazole, mercaptothiazole, mercaptotriazole, mercaptothiadiazole, mercaptotetrazole, selenotetrazole, mercaptooxadiazole, selenobenzothiazole, mercaptobenzoxazole, selenobenzoxazole, mercaptobenzimidazole, selenobenzimidazole, benzodiazole, or benzisodiazole, such that an inhibitor moiety comprising H—INH—L—Y has a calculated log P of greater than 0.4 and n is 0, 1 or 2;

L is a divalent connecting group containing a chemical bond which is broken in a photographic developing solution; and Y represents an alkyl group, an alkenyl group, an aryl group, or a heterocyclic group.

25. A color reversal silver halide photographic light-sensitive material suitable for development in a color reversal process, wherein said process includes a color developer solution at a pH of at least 11.4, the material comprising a support having a silver halide emulsion layer comprising a compound capable of releasing a development inhibitor having a decomposition half-life in the range of above 4 to 225 hours at pH 10, said inhibitor after decomposition having substantially no photographic inhibitor properties, the compound having formula:

$$CAR—(TIME)_n—INH—L—Y \quad (I)$$

wherein:

CAR is a carrier moiety released from —(TIME)$_n$—INH—L—Y by reaction with oxidized developer;

TIME is a timing group;

INH—L—Y is a development inhibitor moiety selected from the group consisting of oxazole, thiazole, diazole, oxathiazole, triazole, thiatriazole, tetrazole, benzimidazole, indazole, isoindazole, mercaptothiazole, mercaptotriazole, mercaptothiadiazole, mercaptotetrazole, selenotetrazole, mercaptooxadiazole, selenobenzothiazole, mercaptobenzoxazole, selenobenzoxazole, mercaptobenzimidazole, selenobenzimidazole, benzodiazole, or benzisodiazole such that an neutral inhibitor moiety comprising H—INH—L—Y has a calculated log P of greater than 0.4 and n is 0, 1 or 2;

L is a divalent connecting group containing a chemical bond which is broken in a photographic developing solution; and Y represents an alkyl group, an alkenyl group, an aryl group, or a heterocyclic group.

26. The photographic element in accordance with claim 24 wherein INH—L—Y is selected from:

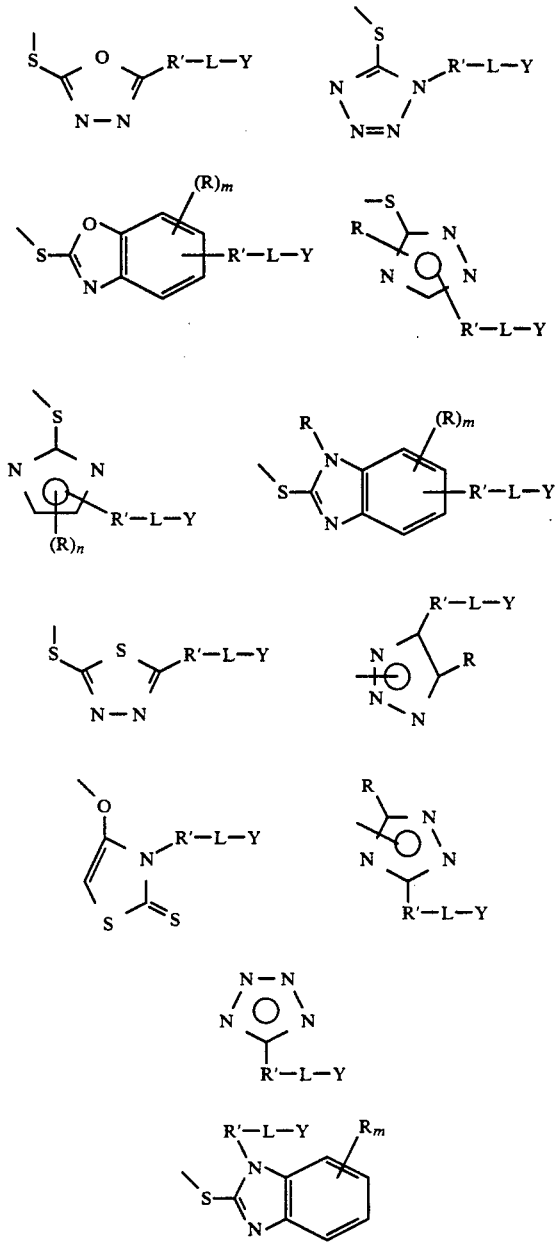

wherein R′ is selected from an alkyl group, an aryl group, or a 5- or 6-membered heterocyclic ring, alkoxy group, aryloxy group, alkoxycarbonyl group, aryloxycarbonyl group, amino group, sulfamoyl group, sulfonamido group, sulfoxyl group, carbamoyl group, alkylsulfo group, arylsulfo group, aryloxycarbonylamino group, alkoxycarbonylamino group, acylamino group, ureido group, arylthio group, alkylthio group; R is selected from those listed for R′ above, or is selected from hydrogen, fluorine, chlorine, bromine and iodine, hydroxy group, or cyano group; when there are two or more R groups on a molecule, R may be the same of different; n is 0 to 2 and m is 0 to 3.

27. The photographic element in accordance with claim 25 wherein INH—L—Y is selected from:

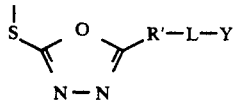

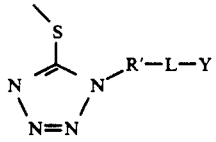

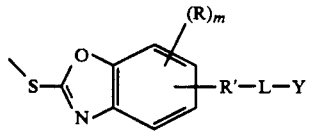

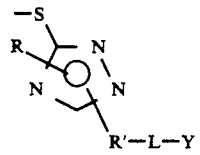

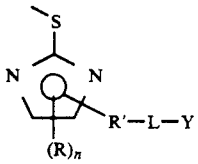

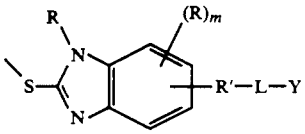

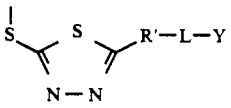

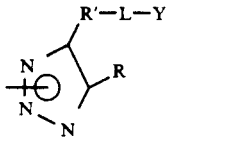

-continued

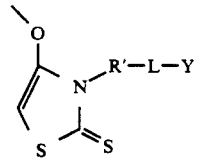

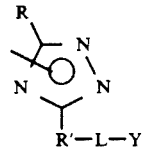

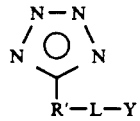

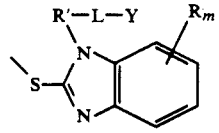

wherein R′ is selected from an alkyl group, an aryl group, or a 5- or 6-membered heterocyclic ring, alkoxy group, aryloxy group, alkoxycarbonyl group, aryloxycarbonyl group, amino group, sulfamoyl group, sulfonamido group, sulfoxyl group, carbamoyl group, alkylsulfo group, arylsulfo group, aryloxycarbonylamino group, alkoxycarbonylamino group, acylamino group, ureido group, arylthio group, alkylthio group; R is selected from those listed for R′ above, or is selected from hydrogen, fluorine, chlorine, bromine and iodine, hydroxy group, or cyano group; when there are two or more R groups on a molecule, R may be the same or different; n is 0 to 2 and m is 0 to 3.

28. The photographic element of claim 24 wherein CAR is a coupler moiety.

29. The photographic element of claim 25 wherein CAR is a coupler moiety.

* * * * *

UNITED STATES PATENT AND TRADEMARK OFFICE

CERTIFICATE OF CORRECTION

PATENT NO. : 5,310,642
DATED : May 10, 1994
INVENTOR(S) : J. Ramon Vargas, et al.

It is certified that error appears in the above-indentified patent and that said Letters Patent is hereby corrected as shown below:

Col 60, line 62, delete "The" and insert --- A ---.

Col 62, line 65, delete "of" and insert --- or ---.

Signed and Sealed this

Eleventh Day of October, 1994

*Attest:*

*Attesting Officer*

Bruce Lehman

BRUCE LEHMAN

*Commissioner of Patents and Trademarks*